US006267052B1

(12) United States Patent
Hill et al.

(10) Patent No.: US 6,267,052 B1
(45) Date of Patent: Jul. 31, 2001

(54) PRINTING WITH DIFFERENTIAL RECEPTIVITY

(75) Inventors: George R. Hill, Stockport; Mark D. Godden, Bristol, both of (GB)

(73) Assignee: Contra Vision Limited, Cheshire (GB)

( * ) Notice: Subject to any disclaimer, the term of this patent is extended or adjusted under 35 U.S.C. 154(b) by 0 days.

(21) Appl. No.: 09/297,020

(22) PCT Filed: Oct. 24, 1997

(86) PCT No.: PCT/GB97/02788

§ 371 Date: Apr. 22, 1999

§ 102(e) Date: Apr. 22, 1999

(87) PCT Pub. No.: WO98/17480

PCT Pub. Date: Apr. 30, 1998

(30) Foreign Application Priority Data

Oct. 24, 1996 (GB) ..... PCT/GB96/02600

(51) Int. Cl.[7] ..... B41M 3/00; B41M 1/18; B44C 1/22

(52) U.S. Cl. ..... 101/211; 156/277; 427/264; 427/265; 427/273; 428/195

(58) Field of Search ..... 400/120.18; 347/212; 427/264, 265, 270, 273; 428/187, 195; 101/115, 129, 211; 156/277; 399/249, 264

(56) References Cited

U.S. PATENT DOCUMENTS

| | | | | |
|---|---|---|---|---|
| 1,928,758 | * | 10/1933 | Mairson et al. | 101/211 |
| 4,527,171 | * | 7/1985 | Takanashi et al. | 347/212 |
| 4,673,609 | * | 6/1987 | Hill | 428/187 |
| 4,704,615 | * | 11/1987 | Tanaka | 347/212 |
| 4,925,705 | * | 5/1990 | Hill | 427/259 |
| 5,116,148 | * | 5/1992 | Ohara et al. | 400/120.18 |
| 5,440,329 | * | 8/1995 | Meggitt et al. | 347/212 |
| 5,830,529 | | 11/1998 | Ross | 101/211 |
| 5,858,155 | * | 1/1999 | Hill et al. | 156/277 |

FOREIGN PATENT DOCUMENTS

| | | | |
|---|---|---|---|
| 2221920 | * | 10/1974 | (FR) . |
| 2.221.920 | | 11/1974 | (FR) . |
| 2118096 | * | 10/1983 | (GB) . |
| 2165292 | * | 4/1986 | (GB) . |
| 2188873 | * | 10/1987 | (GB) . |
| 53-33723 | | 3/1978 | (JP) . |
| WO 97/47481 | | 12/1997 | (WO) . |

OTHER PUBLICATIONS

Patent Abstracts of Japan, 62–270377, Koichi, Nov. 1987.*
Patent Abstracts of Japan, 63–71385, Yoichi, Mar. 1988.*
Derwent Abstract, JP 62–270377, Nov. 24, 1987.
Derwent Abstract, JP 63–071385, Mar. 31, 1988.

* cited by examiner

*Primary Examiner*—Stephen R. Funk
(74) *Attorney, Agent, or Firm*—Pillsbury Winthrop LLP

(57) ABSTRACT

A method of imaging a substrate is disclosed, the method consisting of applying a first layer to the substrate to form a "print pattern" and a second step of presenting an "addressed design" to the substrate both within an outside the area of the print pattern. In the method of the invention, within the print pattern the addressed design is formed into a "durable image material" forming at least a part of the design layer and outside the print pattern, the addressed design does not form a durable image material.

109 Claims, 12 Drawing Sheets

21
12
13
14

11
12
13
11
11
14

31
20
11
11
20
20
16
31

17
32
24
16
31

PRINTING WITH DIFFERENTIAL RECEPTIVITY

This application is the national phase of international PCT/GB97/02788 filed Oct. 24, 1997 which is designated the U.S.

FIELD OF THE INVENTION

This invention relates to the partial printing of a substrate with a plurality of layers with substantially exact registration using an imaging technique for at least one layer which forms a durable image material over a suitably receptive area but which does not form a durable image material over a non-receptive area.

BACKGROUND OF THE INVENTION

There are a number of visual and other functional benefits in printing only part of the surface area of a substrate. For example, it is common to partially print a substrate with one or more colors to allow the revealed substrate which is left exposed to form part of the required design.

White is the most common color of substrate to be printed over part of its area and revealed in other parts, firstly because it is easiest to achieve the desired perceived color of other colors if they are printed on white, especially if such colors are formed by transparent or translucent inks. Secondly, white forms a good contrast to many other colors and so renders graphic designs easily visible. Thirdly, white commonly forms a significantly high percentage of many designs. Fourthly, the mass processing of white substrates provides economy and efficiency in production, by standardization of the base color, if not the material specification. Fifthly, white forms the normal background to four color process printing, in which four colors (black, cyan, magenta and yellow) are typically printed in dot patterns onto a white background, the size and/or spacing of the dots of each color being varied according to "color separations" to be replicated or by digital printing techniques utilizing Raster Image Processing (RIP). From above a minimum distance, the eye cannot resolve the individual colored dots but the colored dots merge to give a combined perceived color at any position on the printed product.

Conventional printing processes typically suffer inexact registration, owing to i) printing machine error or "tolerance" in delivering ink or other marking material, ii) the dimensional instability of a liquid ink or other marking material in liquid state on a substrate, iii) the dimensional instability of a substrate through temperature and humidity changes between printing "passes" (printing of individual layers), and iv) the error or "tolerance" in delivery of a substrate into the printing position.

For many products, this lack of registration, or lack of being able to print ink on a substrate exactly where intended, is not important. However, there are a number of products which can be very adversely affected by such lack of registration, one example being unidirectional or other vision control products, such as those disclosed in British Patent No. 2165292, which includes methods of printing with substantially exact registration and methods of overcoming the limitations of registration error of conventional printing methods. Such products typically comprise the partial printing of a transparent substrate with a fine pattern in the form of dots or lines with surrounding or intermediate transparent areas or of a grid pattern surrounding transparent areas.

A cross-section taken through such partially printed substrates will typically be in the form of a continuous substrate material on which are alternate printed portions and unprinted portions. These printed portions typically comprise superimposed layers of marking material. It is generally advantageous for a plurality of layers within some or all of the printed portions to be in substantially exact registration with coterminous boundaries. For some products, it is advantageous or essential for at least one layer to not extend over the whole area or areas of another layer but to lie within the other layer, either wholly spaced within or partly spaced within and partly having a coterminous length of boundary. When the cross-sectional dimensions of the printed portions of such a printed product are small and it is desired to superimpose more than one layer on such printed portions, the registration error of conventional printing processes can severely prejudice the achievement of the desired visual or other performance criteria. The critical factor is the registration error or tolerance of the printing process compared to the cross-sectional dimensions of the printed portions.

In the case of conventional four color process printing (sometimes referred to as four color half-tone printing) or digital four color process printing, the size of the individual dots of color are very small in relation to the area of the background substrate, which is typically white and made of paper, card or plastic materials. Substantial lack of registration in the printing of the individual dots of different colors is normally acceptable, as the individual dots of one color are not perceived as individual dots but are combined with the differently colored dots to provide the required overall impression. Lack of registration between the dots of various colors is only generally perceived as a lack of sharpness of design boundaries within the design, such as the edges of insignia seen against a background color. The observer sees what is printed. Only if the observer knows that the desired degree of edge clarity is different to that observed, or if the lack of registration is such that color "halos" are seen at color boundaries, is the lack of registration recognizable.

However, if the requirement is to print a relatively fine pattern of background color, such as white dots, then superimpose one or more single colors, of uniform hue, intensity and tone, or four color process colors, on some or all of these dots, the lack of registration of the printing process can have a significantly deleterious effect on the functional performance compared to that intended. For example, the perceived colors of an image or design will vary over the area of the substrate from the desired colors owing to the visual interaction of the unregistered layers. If a pattern of 1 mm sided square white dots are intended to be covered with 1 mm sided square dots of a different color, but there is a registration error of 0.2 mm in two orthogonal directions on plan, as in FIG. 1 of the accompanying drawings, then 36% of the desired area will appear white and have a corresponding effect of 0.36 $mm^2$ white on the overall printed area of 1.36 $mm^2$. If the substrate is black and the different color is formed by transparent ink, the different color will be substantially invisible against the black substrate and the 0.36 $mm^2$ of white will be seen in combination with the 0.64 $mm^2$ area of the different color, which will appear consequently "whitened" in this area. Such alteration from the desired perceived color will be most noticeable compared to other individual squares making up the pattern where the error in registration differs and particularly compared to any squares in which the different color substantially covers the white. The different color was intended to appear uniform over an area of panel, it will instead appear to be shaded, of differing tone.

If the substrate is transparent, such lack of registration will be typically visible from the other side of the substrate as well, the overlapping different color in the above example being visible as well as the white square, which will typically not be desired.

There is another problem, that undesirable perception of color can be caused by lack of opacity of individual ink layers. In the above example, if the white and different color were printed on a transparent substrate, when the white is observed from the other side of the substrate, this could be modified by the different color, which could be exacerbated by the illumination condition behind the substrate.

From the printed side of the panel, the different color covering the white area would be perceived as being a whitened or a lighter color tone of the different color. It is common in printing to overcome such lack of opacity by printing more than one layer of a color, to achieve the desired or necessary degree of opacity. However, if the registration error is relatively large compared to the cross-sectional dimensions of the printed portions being printed, the lack of registration will result in yet further areas of different perceived color where the edges of the desired shape overlap through lack of registration, as well as poor edge definition.

Methods of substantially exact registration printing utilizing differential adhesion of a layer of marking material onto a substrate are disclosed in British patent numbers 2118096 ('096), 2165292 ('292) and 2188873 ('873). The first layer of one material defines a print pattern (referred to as a silhouette pattern in '292). This first layer may be in the form of the print pattern or be a stencil of the print pattern. A second layer of a different material, typically a printing ink, is applied over the print pattern and beyond the boundaries of the print pattern. This second layer adheres within the print pattern but does not adhere to the substrate outside the print pattern. The second and any further layers typically comprise printed ink, which is cured and subsequently removed from outside the print pattern, for example by the application and removal of self-adhesive tape or by high pressure water hosing. The curing regimes of the ink layers to enable removal of unwanted ink, and the means of such ink removal are difficult, costly and time consuming.

The prior art also includes Japanese Unexamined Patent Publication number 33723/78 to Kawai entitled "Method of Thermally Transferring Metal Foil onto Outer Surface of Hard Substrate". This document also outlines the previous prior art of hot foil stamping and the hot roller transfer from a carrier of a printed design onto a substrate. Kawai discloses the method of thermally transferring a continuous foil of metal or synthetic resin onto a thermo plastic synthetic resin ink, paint or glue which is first adhered to and cured on the outer surface of a plate like or molded hard substrate such as glass, ceramic, metal, marble, cured synthetic resin or the like. The method of Kawai does not allow for the partial coverage of the first layer which is adhered to the substrate.

Another problem when making products according to the '292 invention by the prior art methods is that Moire fringe patterns can result from using four color separations superimposed on a dot or line "silhouette pattern".

SUMMARY OF THE INVENTION

The purpose of this invention is to overcome or at least minimize all the above-mentioned prior art problems in the partial imaging of a substrate.

According to the invention there is provided a method of imaging a substrate comprising of: applying a first layer to said substrate to form a print pattern and presenting an addressed design to said substrate both within and outside the area of said print pattern; characterized in that within said print pattern said addressed design is formed into a durable image material forming at least one design color layer and outside said print pattern said addressed design does not form a durable image material.

The invention provides several benefits over the prior art, including achieving substantially exact registration printing while avoiding the need for removal of unwanted layers of cured ink, enabling a discontinuous "design layer" to be superimposed on a "print pattern" by a number of conventional and digital printing methods and avoiding the exceptional problems of Moire fringe patterns which otherwise occur when printing typical "silhouette patterns" of the '292 invention. Individual methods referred to later have their own further specific benefits over the prior art.

A "substrate" may be a single sheet of homogeneous material or a multi-layer material or assembly, for example incorporating the overall application of a printed ink layer. The substrate is substantially imperforate, except for any holes that may be used to assist printing registration or to feed the substrate through a printing or other machine.

In all embodiments of the invention, only part of the substrate is imaged, termed the "print pattern". The "print pattern" may comprise a plurality of discrete elements and/or an interconnected pattern surrounding a plurality of discrete voids. Examples of print patterns include a pattern of dots or lines or a grid, net or filigree pattern.

In all embodiments it is possible to take a particular cross-section through a panel of the invention comprising the substrate having two outer edges and the print pattern having one or more printed portions and one or more alternate unprinted portions, each printed portion having two outer edges. At least one and typically all the printed portions comprise a "background color layer" of one material, for example printed ink, which extends over all but not outside the print pattern. A background color layer may be a first layer applied to a substrate which forms and defines the "print pattern." At least one of the printed portions comprises a "design color layer" of imaging material which has two outer boundaries and typically overlies or underlies a "background color layer" within every printed portion within the two outer boundaries of the design color layer. A "design" is the visible image of one or more "design layers" typically seen superimposed in front of a background color layer.

The term "design layer" means a layer of material that is applied as at least a part of the "addressed design" or a layer of material which is changed in state within the area of the "addressed design" that also lies within the print pattern, for example by the application of heat, light or electrostatic charge as means of presenting the addressed design. The design layer comprises at least one design color layer and can be a single layer of a single material, such as a single design color layer of ink, or a multi-color printing process layer, in which the individual design color layer deposits, typically of black, cyan, magenta and yellow, are typically discontinuous within the design layer and any printed portion within the design layer.

Within a particular cross-section, a design layer has two outer boundaries and within the two outer boundaries each printed portion is constructed to have two outer edges of a part of the design layer lying within the two outer edges of the printed portion, which includes the possibilities of the two outer edges of a part of the design layer being spaced within the two outer edges of a printed portion or one outer edge of a part of the design layer being coterminous with an outer edge of a printed portion or the two outer edges of the parts of both the design layer and the printed portion being coterminous. In a particular cross-section taken through the printed substrate, at least one design layer must be applied to at least two printed portions of the print pattern separated by at least one unprinted portion of the substrate. The design layer may extend over the whole of the print pattern and typically does so in the case of a multi-color process design.

A "design color layer" comprises a material of one color, of substantially uniform hue, intensity and tone, within a design layer. The term "design color layer" includes the individual colors of a multi-color printing process, such as black, magenta, cyan and yellow. At least one design color layer does not extend over the whole of the print pattern.

A "durable image material" means an imaging material that is in a durable, substantially fixed chemical and solid state in a fixed geometrical relationship to a substrate. For the avoidance of doubt, a cured ink layer outside the silhouette pattern in the prior art methods of GB 2165292 is a durable image material, requiring an ink fracture mechanism to remove it from the ink within the "silhouette pattern" of those methods. The prior art methods requiring an ink fracture mechanism to remove cured ink include high pressure water jetting requiring a pressure of not less than 1,500 lb/in$^2$ (105 kg/cm$^2$) and typically over 2,000 lb/in$^2$ (140 kg/cm$^2$) with a rate of water flow of not less than 10 liters/minute and typically 15 liters/minute. The Improved Exact Registration methods described herein either do not leave any image outside the print pattern or, if any marking material is deposited on the substrate outside the print pattern, it can be substantially and easily removed by being washed off with water with a pressure of not greater than 200 lb/in$^2$ (14 kg/cm$^2$) with a rate of water flow of not more than 10 liters/minute, less than one tenth of the water pressure at less volume than is required for the prior art methods of production, or the equivalent mass per minute of another abrading medium. Alternatively, particularly if the substrate and or durable image material would be damaged by the application of water, then the unwanted material can be removed by air jetting or wiping with a dry cloth. Image material on the substrate that can be moved by such water washing or dry methods of removal is not durable image material.

The term "addressed design" means a geometrical layout that is independent of the print pattern that extends both within boundaries of the print pattern and outside the boundaries of the print pattern and defines the extent of a design layer within the print pattern. An addressed design may encompass a single design color layer or a multi-color process, including a two color, a four color or a hexachrome process. An addressed design may comprise a plurality of digitally addressed micro-elements, typically as part of a "digital printing method".

The term "presenting an addressed design" includes the physical application of a layer of printing ink, thermal transfer resin, toner or other marking material to the substrate or a previously applied layer, or such materials may be presented in a spaced relationship from the substrate, for example to be attracted by electrostatic charge within the printed portions of the substrate or of a previously applied layer, or includes the application of energy such as heat, light or electrostatic charge within the "addressed design" to a substrate or previously applied layer that is amended by such energy.

"Digital printing methods" include those processes grouped under the categories of Electrographic or Electrostatic, Thermal Transfer sometimes referred to as Thermal Mass Transfer and Thermal Dye Sublimation, Direct Thermal, Photographic and Ink Jet digital printing. Digital printing methods typically use a Raster Image Processor for enabling the positioning and size of deposits of black, cyan, magenta and yellow material in a four color process and/or additional 'spot colors'. A 'spot color' has a substantially uniform hue, intensity and tone. In such digital printing methods, very small deposits of an individual color of marking material are addressable to the surface of a substrate, for example a deposit of pigmented resin foil by an individual node of a transfer head of a thermal foil transfer machine, such as the GERBER EDGE, a trademark of Gerber Scientific Products, Inc., USA, or the individual deposit resulting from a single impulse of a single ink jet of an ink jet printing machine. The invention encompasses any method of digital printing in which small deposits of marking material are individually addressable to a substrate or a transfer carrier or a transfer drum. It also encompasses methods in which micro elements of a substrate or sensitive layer can be addressed by correspondingly controlled energy impulses.

In one embodiment, a first layer of material is applied to a substrate in the form of and thus defining the print pattern. This first layer is typically white and is receptive to a method of design imaging, for example thermal transfer, but the substrate is not receptive to the method of design imaging, for example a polyester. For example, the pigmented resin coating on a carrier film that lies within the addressed design is transferred and adhered to the first layer to form a design layer. However, the area of the pigmented resin coating outside the print pattern is not adhered to the substrate but is carried away on the carrier film.

In another embodiment, the print pattern is printed on a substrate in a first layer of black material. Then a white layer is printed within and spaced inside the black layer. Both the black and white layers are print-receptive. The discrete or interconnected white areas are overprinted with the desired design layer or design layers using transparent or translucent ink, which overlaps the white layer and covers those parts of the first black layer within the addressed design. The combination of the printed transparent or translucent design color layer superimposed on the printed white layer produces the desired perceived color. This result is achieved because, on each printed portion, the transparent or translucent design color ink is not readily visible against the black background but combines with the white layer to produce the desired perceived color. In this embodiment, both the black and white layers are receptive to the design layer but the substrate area outside the black layer is not receptive to the design layer.

In yet another embodiment, the invention may be used to print a pattern of dots, lines or a grid pattern on a transparent substrate to manufacture a product of similar performance characteristics to those in British Patent No. 2165292. In such products, there is a "silhouette pattern" of opaque material "which subdivides a panel into a plurality of opaque areas and/or transparent or translucent areas", typically having an array of many discrete elements such as dots or lines or interconnected elements to achieve a relatively fine continuum pattern of opaque portions of cross-sectional width less than 5 mm and typically 1–2 mm. Within the silhouette pattern, there is typically a number of superimposed ink layers, typically white on black, and a design superimposed on the white layer that is visible from one side of the panel which is not visible from the other side of the panel. British Patent No. 2165292 describes a number of methods of production which can achieve this effect, some providing exact or substantially exact registration of superimposed black and white ink layers. According to the present invention, the white on black layers form the print pattern and one or more design layers are applied to the print pattern but do not form a durable marking material outside the print pattern.

In a still further embodiment, the invention may be used to print transparent substrates to form products according to PCT/GB96/00020, in which the print pattern is typically defined by a first layer of clear or translucent white material typically in a fine continuum print pattern comprising a plurality of discrete areas and/or a plurality of voids in the print pattern, such as a pattern of dots or lines or a gridlike pattern with circular or other shaped voids revealing the substrate. One or more design layers are applied in transparent or translucent marking material or other imaging system to the print pattern but not to the non-receptive substrate outside the print pattern. The resulting design on such products, when viewed from one side, may be illuminated from the other side, as the print pattern and superimposed design are transparent or translucent. Such panels also allow a degree of vision through the panels, in either direction.

The present invention provides for the management or elimination of registration error in a printed product, registration error that would otherwise cause deficiencies in the printed product. The prior art methods of achieving substantially exact registration by conventional screen or other printing methods use liquid inks, which are cured in successive layers of ink and then the unwanted ink is removed by a relatively difficult means, that requires an ink fracture mechanism around the print pattern. The present invention avoids the need for this removal of cured ink. Unlike the thermal transfer method of Kawai, a design layer is not a continuous deposit over the whole of the print pattern. Additionally, with several digital printing systems, the design color layers are individually addressable to form a multi-color process design layer with one "pass" of the substrate through the machine, without intermediate curing of ink regimes, thus largely eliminating printing registration errors due to substrate dimensional instability within the design itself. The invention allows some methods of printing, such as thermal transfer printing, to be used that are not suitable for the prior art methods of achieving substantially exact registration by removal of ink by an ink fracture mechanism requiring high water pressure hosing or the application and removal of self-adhesive film with a high adhesive "tack", that would damage marking material such as thermally transferred pigmented resin. The invention therefore has distinct advantages over the prior art.

While it is possible to reduce the problems of registration error by pre-printing a design on a transfer medium or roller and selectively transferring this to the required print pattern, the invention enables the control of direct digital printing of a substrate. "Direct digital printing" in this context means the application of individual colors, such as "spot colors" or the individual black, cyan, magenta or yellow colors of a four color printing process, delivered from their individual sources, such as ink or toner reservoirs or a thermal transfer foil cartridge, rather than a pre-printed four color process design on a transfer medium or roller. Such direct printing typically has benefits of reduced time and reduced costs.

In all the above embodiments, it is generally advantageous for one or more layers to be opaque, typically of opaque white and/or black, onto which transparent or translucent second layer inks can be applied, for example by a four color digital printing system. It may be preferable to print such opaque background layers by screenprinting or other means of applying relatively thick layers of relatively opaque ink. Opaque print patterns of white-on-black ink may be produced according to methods disclosed in GB2118096 or GB2165292. The black layer in such products is to provide a light absorbing layer which allows relatively clear vision through otherwise transparent substrates, the black print pattern not affecting the eye and not noticeably attracting the colors of any object seen through such panels, other than in a manner similar to a neutral tint. However, the present invention enables the first layer defining the print pattern to be printed in black and a white background color layer to be applied to the black layer in substantially exact registration but not to the non-receptive substrate. For example, a print-treated clear polyester substrate is printed with a black pvc ink print pattern. A white thermally transferred pigmented resin layer will adhere to the black print pattern but not the substrate. One or more design layers can then be applied by thermal transfer.

In another embodiment, a tinted and preferably neutral tinted transparent substrate is printed with a first single or multiple white layer defining the print-receptive print pattern. The neutral tint has the effect of reducing the visibility of a white print pattern when viewed through the tinted substrate, in the manner disclosed in GB 8320969 (Cass). This white opaque print pattern is then superimposed by transparent or translucent imaging system to which the tinted substrate is non-receptive.

In all the above embodiments, instead of the first layer being typically a printed layer, the print pattern can be provided in the form of cut film, preferably cut self-adhesive film, applied to a transparent, translucent or opaque substrate such as raw or treated polyester film. The term "film" covers any film, for example plastics materials, such as polyvinyl chloride or polyester, a paper or a metallic foil. The film will itself form a receptive surface, for example polyvinyl chloride film which is typically receptive to many printing systems or will be surface coated or have an integral surface treatment suitable for one or more imaging methods. For example, the film may have a catalytic component in a coating complementary with another catalytic component in a design layer ink. As another example, the film can be coated with a light or heat sensitive material, such as a photographic coated paper.

Self-adhesive film can advantageously form a print pattern of lines running parallel to the length of web of the imaging process, to provide a smooth passage through such machines, for example the GERBER EDGE thermal transfer imaging system, whereas for example a pattern of lines perpendicular to the web length or imperfectly punched, perforated material would provide edges that could cause interference with the performance of such imaging machines by providing a physical discontinuity obstruction.

The substrate in such embodiments is typically non-receptive to imaging such a "raw" polyester.

With some such substrates, a marking material such as ink jet ink may be physically applied to the substrate outside the print pattern but not form a durable marking material, being capable of easy removal by low pressure water washing, wiping or other means. It is advantageous for the cut film to be in a print pattern of lines or other discrete elements, to assist the removal of such non-durable marking material, compared to a perforated film. With perforated film, unwanted marking material would be trapped in the holes, making total removal of unwanted marking material relatively difficult, if not impossible.

Alternatively, the substrate can be release coated, for example silicone-coated polyester or silicone-coated paper or film materials coated with a fluoro chemical such as FC 208. A silicone-coated material will typically not be receptive to any conventional printing or other imaging system, in contrast with a suitably selected and cut self-adhesive film used to form the print pattern.

Thermal transfer pigmented or dye resins and electrostatically printed toners will not adhere to a silicone-coated surface. No marking material is deposited, as no thermal transfer pigmented resin will be transferred or no electrostatically printed toner will be transferred from a carrier onto the silicone coating. If marking material is deposited on a silicone-coated surface, such as ink jet inks, they will typically form into globules and not adhere to any degree, and are capable of being removed by low pressure water washing, wiping, a cleanable roller or by blowing air, such as by an "air knife", especially if the cut film is in a pattern of lines or other discrete elements.

Such release-coated substrates typically form part of the finished product. For example, a silicon-coated clear polyester film of say 50$\mu$ to 100$\mu$ thickness forms an ideal transparent base material for a window sign or a hanging banner with a design according to GB2165292. Alternatively, the release-coated substrate acts as a release liner, to be subsequently removed, to enable the application of the cut self-adhesive film, typically in the form of stripes, to a window or other base material.

The transfer of design imaged, self-adhesive film stripes to a window or other base material is normally facilitated by a self-adhesive application tape applied over the assembly of cut self-adhesive film stripes and release liner, on the side remote from the release liner. Before application, the release liner is removed and the self-adhesive film stripes are held in their required relative position by the application tape until the self-adhesive surfaces of the stripes are firmly applied to the window or other base material. Then the application tape is removed, unless this is in the form of an overlaminate which is retained to protect the cut film and superimposed design, for example from the weather or abrasion or UV degradation. Such overlaminate preferably has a higher tack adhesion to the printed design on the stripes than the stripes have to a window or other base material, to facilitate easy removal of the stripes, when so required, in one "pull", to avoid the time-consuming process of picking off individual stripes.

Such stripes may be in the form of straight lines or curved lines, the latter having the advantage of avoiding the possibility of straight line design features, such as the edges of certain letter character indicia, being 'lost' if they are 'addressed' to a gap between stripes.

A further advantage of stripes compared to perforated material is that if they are attached vertically to a window, for example to form a panel according to GB 2165292 with a design visible from outside the window, they allow the gravitational drainage of rain or other water, whereas with perforated film materials, such water is typically retained in the holes until it evaporates. The surface of the water in each perforated hole forms a meniscus, causing the retained water to act as a distorting lens, preventing the typically desired vision through such panels, from inside the window to outside the window. Also, if a perforated film applied to a window has an overlaminate, it is typically subject to interstitial condensation between the overlaminate film and the window, when the temperature falls below the dew point of the trapped air within the perforated holes. The condensed water is trapped in these perforation holes, obscuring through vision. Vertical stripes have the additional advantage in such conditions of interstitial condensation, that the condensed water can drain down or relatively freely evaporate from between the stripes and thus allow good through vision. Gaps between vertical stripes would normally be sealed at the top of a panel of stripes by the overlaminate overlapping above the stripes or a separate tape or a liquid sealant being applied to the top of the stripes.

The production of such film stripes to form a receptive print pattern may be achieved by many methods. A preferred method uses a slitting cylinder to face-slit the facestock and pressure-sensitive adhesive but not the release liner to a self-adhesive assembly along the length of the web, into the required stripe widths. Alternate print-receptive stripes are removed and redeposited at the required spacing onto another release liner providing a non-receptive surface for printing, typically transferred from one roll of release liner material onto another roll of release liner material or other non-print-receptive material.

In another embodiment, the self-adhesive film stripes are removed to another self-adhesive assembly, for example having a transparent raw polyester facestock, that is not print-receptive to one or more imaging methods. In this embodiment, the stripes are held in their desired position by the facestock during transfer to a window or other base material, rather than by application tape, and are subsequently easily removed in one operation by removal of the self-adhesive facestock from the window or other base material.

Before such face-slitting of self-adhesive film facestock and adhesive, it may be printed with a background color or background design by conventional means, which would form a background to the subsequent printing with differential receptivity.

Yet another advantage of stripes over perforated materials is that, if they are arranged to be vertical in the finished product, for example as applied to a window as part of a panel according to GB 2165292, through vision from either side to the other side is enhanced compared to perforated film materials or horizontal stripes. The normally horizontal disposition of a person's two eyes enable vision of a small object or feature beyond the panel by convergence of sightlines from the two eyes around a vertical stripe, whereas a horizontal line or perforated material can completely obstruct such small objects. The principle of this feature can easily be demonstrated by looking at a small object such as a distant tennis ball through metal balustrade railings; the object will always be visible through vertical railings but can typically be blocked from vision by a horizontal member of the balustrade, depending of course on the proximity and positioning of the eye in relation to the balustrade.

In all these embodiments comprising self-adhesive film stripes, all the print-receptive film material is available to be printed or otherwise utilized, whereas with perforated materials, the material cut to form holes is typically wasted, typically up to 50% of the material being lost. The face slitting and transfer of self-adhesive stripes onto another substrate roll is a more economic and much faster operation than perforating self-adhesive film by punching, laser cutting or other means.

There are therefore several significant advantages of using cut self-adhesive film, print-receptive stripes over the prior art methods using imperforate and perforated materials, The cut self-adhesive film facestock can be a single layer, typically of opaque or translucent white material or clear transparent material, or can be multilayer, for example a white-on-black laminate of polyvinyl chloride and/or polyester film for the manufacture of products according to GB 2165292. The incorporation of polyester film into one or more layers of the facestock increases its strength and dimensional stability, assisting the transfer of stripes of narrow width, say 2–4 mm width, from one roll of release liner material to another or to a window or other base material. Clear, transparent self-adhesive film is typically used for reverse printing of a design, for example if the design is to be seen from outside a window after application of the cut self-adhesive film onto the inside of the window. An alternative method of applying a cut film product to the inside of a window is, after a design has been applied to the cut film and not the non-receptive substrate, adhesive can be selectively printed or otherwise applied on to the design on the cut film. The adhesive can then be applied to the inside of a window and the substrate can be retained as a protective layer or, if in the form of a release liner, it can be removed to leave the cut film on the window.

The cut film need not be part of a self-adhesive, pressure-sensitive assembly but may be applied to the substrate material by other means, for example by solvent adhesive or by heat-lamination.

Instead of the design being applied to a cut self-adhesive film applied to a non-receptive substrate, a non-receptive substrate may have pressure-sensitive or other adhesive selectively applied in the form of the print pattern and the design may then be selectively applied to the adhesive but not the substrate. For example, a polyester film may be printed with a line pattern of white printable adhesive. The design may then be selectively applied to the adhesive but not the non-receptive substrate by a method that preferably retains sufficient adhesive capability to apply the imaged product to a base material such as a window.

Alternatively adhesive may be selectively applied to the surface of a non-print-receptive substrate, to register approximately with a print-receptive layer of material applied to the other side of the substrate. For example black pressure-sensitive adhesive may be applied in a pattern of stripes to one side of a transparent polyester substrate having a pattern of white lines printed on the other side of the substrate, each stripe of black adhesive preferably overlapping a white printed line. When a design layer is selectively applied to the white lines it is not visible from the other side, being masked by the black adhesive. This embodiment has the additional advantage over the prior art of transparent substrate and transparent adhesive of leaving the gaps between the adhesive uncoated and thus optically unaffected by the presence of an adhesive layer.

All non-perforated self-adhesive films require some skill in their application to a base material such as a window, as it is difficult to remove trapped air bubbles. Particularly for transparent self-adhesive films, such air bubbles can significantly detract from the appearance of the finished product. It is therefore advantageous to selectively slit such self-adhesive substrates, preferably within the area of the print pattern, to enable the easier removal of air bubbles when applying such products. If the slits are within the print pattern and not the transparent area or areas, they are typically not noticeable after application of the self-adhesive film to a window or other base material. For example, if the print pattern is one of lines, occasional slits of say 5 mm length, parallel to and within the width of individual lines and at 100 mm centers along the length of lines say 100 mm apart, provide a significant advantage in the application of the finished product to a window or other base material. Any trapped air only needs to be squeegeed a short distance to a slit rather than to the edge of a panel.

The invention encompasses the following imaging methods, which may be termed "Improved Exact Registration" printing methods. All the methods present an addressed design to a substrate that has a first layer which defines the print pattern and is receptive to the particular imaging technique over the area of the print pattern but the substrate is non-receptive to the particular imaging technique outside the area of the print pattern.

1. Thermal Transfer Differential Adhesion Method

This method, sometimes referred to as thermal mass transfer, uses conventional thermal foil transfer equipment, such as the GERBER EDGE thermal transfer imaging system. Such machines typically utilize a cartridge of foil comprising a polyester support and a pigmented resin layer or a wax layer, which is passed through a transfer head comprising thousands of mini heat presses, which are activated by computer control utilizing a Raster Image Processor, to melt and bond deposits of the pigmented resin layer to a pvc or other suitable substrate, four passes being required using black, cyan, magenta and yellow foils to build up a four color process image. "Spot colors" and metallic foils are also commonly used. This Improved Exact Registration method requires the print pattern to be determined using a material that is receptive to such thermal transfer on a substrate that is not very receptive to thermal transfer. In one example, a print pattern is applied in one or more layers of pvc ink of relatively high plasticity, such as a typical pvc ink used for vehicle livery, or an ink which can be described as a "vinyl-like ink", such as Coates Vynalam, an ink manufactured by Coates Bros PLC which is an acrylic ink with a pvc content providing a relatively low glass transition temperature (Tg) which can otherwise be described as being more thermoplastic than a typical pvc ink. The receptive ink should preferably be a gloss ink to provide a relatively smooth macro surface topography, preferably white. Alternatively, a clear highly plasticized pvc lacquer or clear Vynalam ink or other material with a relatively smooth and high energy surface can overly a white layer of polyester or pvc ink. This print pattern is applied to a substrate not receptive to thermal transfer, such as a "raw" or print-treated polyester film. When processed in a thermal transfer machine, as for a typical pvc substrate, the pigmented resin layer adheres to the print pattern within the addressed design but not to the substrate outside the print pattern. Because individual nodes are heated to suit the addressed design and because the donor pigmented resin is continuous, there is no tendency for the carrier layer to bond to the print pattern outside the design layer, which would be likely if the method of Kawai was adapted by having a discontinuous design on the carrier.

The method may also use cut film, for example the pigmented resin will transfer to cut self-adhesive polyvinyl chloride film, preferably cut into a print pattern of stripes, on a silicone-coated polyester substrate, to which the pigmented resin will not transfer.

2. Electrostatic Transfer Differential Adhesion Method

Electrostatic, sometimes referred to as Electrographic, processes such as the 3M SCOTCH PRINT electrostatic transfer system available from the Minnesota Mining and Manufacturing Company, USA, typically involve the electrostatic printing of an image on a transfer medium such as 3M reference 8601 or 8603 "Wearcoat" transfer medium. The transfer medium is then passed through rollers with a substrate, such as pvc film, under heat and pressure, which process transfers the image from the carrier to the substrate.

Using similar substrate and print pattern ink materials as outlined in Method 1, it is possible to selectively transfer the pre-printed image to the print pattern but not to the substrate. Preferably, the polyester film should be raw or non-print-treated such as ICI MELINEX polyester film available from ICI plc, reference numbers 701 or 401. With such substrates the electrostatically printed image will transfer to the substrate outside the print pattern as well as the print pattern. However, it will only form a durable image material within the print pattern, being easily removed by low pressure water washing or wiping from outside the print pattern. Silicone-coated substrates have an additional advantage that an electrostatically printed image will typically not transfer to the silicone coating to any degree. Other suitable non-receptive substrates include polyvinyl fluoride, for example TEDLAR UV-resistant window film available from E I DuPont de Nemours and Company.

For example, the electrostatically printed toners will transfer from a carrier film to a print pattern of polyvinyl chloride self-adhesive stripes but not to a silicone-coated substrate to which they are applied, such as silicone-coated polyester.

3. Conventionally Printed Ink or Digital Ink Jet Differential Adhesion Method

This method requires an ink receptive print pattern and an ink repellent substrate and is suited to screen printing, litho printing and other conventional printing methods, as well as digital ink jet printing methods. Some conventional inks and some ink jet inks are water based and will not adhere to conventional pvc, polyester or other such substrates without pretreatment. Substrates such as polyester or polyester treated to receive pvc inks are hydrophobic, rejecting normal water based materials. Inks suited to printing paper or card are typically hydrophilic, receptive to water based inks which adhere and dry on them. One such ink is Hydroprint 2200 Series manufactured by Coates Lorilleux Screen Ltd.

A print pattern is printed incorporating a top layer of white hydrophilic ink. This enables water-based ink jet printing of a "spot color" or four color process design layer, the ink only adhering to the print pattern. The 'free' ink on the areas to be unprinted, which does not adhere, is absorbed into an underlying hydrophilic layer, typically a layer of black ink lying outside the white ink, to avoid contamination of the white layer by absorbed design color layer ink. Alternatively, any remnants of ink outside the print pattern are removed by an air knife, cleaning roller, be wiped off, be washed off or removed by other means They do not cure and do not require an ink fracture mechanism for their removal.

The desired effect is also demonstrated using curable coatings where inks comprised substantially of water-based dyestuffs or pigments dispersed within suitable suspension agents are printed onto a substrate by conventional printing methods or by using plotters or printers provided with a suitable jetting system. Upon completion of printing, the panel is further processed using a heated air drying tunnel, heated rollers, microwaves, photo-initiators or similar. Upon application of the heat or other energy source, the coating cures on the receptive print pattern to render a durable image material, in a dry and substantially indelible state. Ink deposited upon the substrate may be simply removed by washing or wiping.

Alternatively, the differential adhesion may result from a catalytic reaction. The first layer comprises a material comprising a component A which is catalytic with a component B in an ink to be applied in another layer comprising an addressed design over the first layer and to overlap the first layer. The components A and B have a catalytic reaction, for example chemical cross-linking to form a durable marking material and a strong bond between the two layers. The substrate material itself does not comprise component A and when the ink comprising the second layer is applied to the substrate outside the first layer, no corresponding catalytic reaction takes place and the second ink layer remains in an uncured and non-adhered state that is very easy to remove by washing, wiping or other such means. Examples of catalytic components A and B are Hydroxy with Isocyanate, Epoxy with Ameno and Hydroxyl with Carbonyl. Other examples with any attendant components for specific combinations are given in U.S. Pat. No. 5,537,137 to Held et al.

In this method, the desired reaction can also be initiated within a post-imaging process such as washing to effect curing of the design layer upon reactive receptors within the print pattern. Again, ink received upon non-receptive areas of the substrate can easily be removed by washing or wiping.

The desired effect can also be demonstrated using an ink containing a substantial solvent moiety and a first layer coating to which the solvent based ink adhere aggressively. Solvent ink deposited upon the untreated substrate outside the print pattern will remain in an unchanged state and so can again be removed by washing, wiping or similar.

Many different conventional ink printing systems or ink jet technologies can be used including "continuous" ink jet systems and "drop on demand" systems including thermal, piezo and phase change (hot melt), and heated roller ink jet.

The method may also utilize cut film materials that are ink receptive, such as self-adhesive polyvinyl chloride stripes, on a non-print-receptive substrate, such as silicone-coated polyester.

4. Electrostatic Chargeable Print Pattern Method

A substrate is printed with a print pattern that includes a layer of chargeable material and a dielectric charge capture layer, that is charged with an electrostatic latent image, onto which electrostatically charged toner is attracted but is not attracted to the surrounding substrate.

Alternatively, conventional chargeable substrate materials are used but the charge capture layer is only selectively applied in the area of the print pattern.

The electrostatic latent image is charged by an electronic writing stylus immediately before being fed through a toner fountain of conventional liquid toner which is either heat fusible or air dried after being attracted to the print pattern, or powder toner, which is fused by heat and/or pressure after being attracted to the print pattern.

The print pattern comprises a chargeable first layer, such as a paper-based material or paper ink. Alternatively, the coating material used on electrostatically printed pvc film can be selectively coated to a pvc film, typically by screen-printing a pattern of lines.

While it is possible to selectively charge a conventional substrate for electrostatic printing by means of suitable software, toner inks are typically transparent or translucent and it is advantageous for transparent substrates to have an opaque print pattern onto which the toner will be attracted, such as a white print pattern incorporating the chargeable layer and charge capture layer. The white layer may be superimposed on a black layer to make products according to GB2165292.

Alternatively, self-adhesive substrates specifically developed for direct electrostatic imaging (without transfer from a carrier) such as 3M direct electrostatic system vinyl which incorporates a chargeable material and charge captive layer, can be cut to form a print pattern, for example of stripes, applied to a silicone-coated substrate. An electrostatic addressed design will charge the stripes but not the substrate and the toner will be selectively attracted to and applied to the print pattern of receptive stripes but not to the substrate.

5. Dye Sublimation Method

The desired print pattern is provided in one or more layers, at least the top layer containing a receptive coating to dye sublimation processes, such as by Fargo, Inc. of Minnesota, in which dyestuffs are converted to gaseous matter and are absorbed into the receptive layer within the print pattern but not into the substrate outside the print pattern. Alternatively, self-adhesive film suitable for dye sublimation can be cut to form a print pattern on a silicone-coated substrate. The dye will be sublimated onto the print pattern but not onto the substrate.

6. Direct Thermal Method

A substrate is selectively coated with one or more coatings known in the art of thermal imaging, whereas the substrate itself is not receptive to thermal imaging. Example coatings are those used in the art of facsimile transmission. Upon the addressable input or energy at the imaging head, the coating provides changes from white to black thus recording an image upon the print pattern. The substrate has no such coating and does not record an image despite an energy input. State-of-the-art full color direct thermal coatings, such as Fuji's Thermo Autochrome, can also be used, wherein controlled exposure and UV bleaching renders a full color recording to the coating within the area of the print pattern.

Conventional direct thermal printing paper or other film materials can be cut to form a print pattern such as punched, perforated thermal printing paper or a pattern of stripes, and be adhered to a substrate non-receptive to direct thermal imaging, such as silicone-coated polyester.

7. Photographic and Other Light Sensitive Materials Method

The print pattern comprises one or more coatings known in the art of photographic imaging, whereas the substrate is neither reactive to light or photographic chemistry. Thus, a photographic recording displays an image within the extent of the print pattern. Photographic emulsions are typically exposed to an imaging source such as a photographic enlarger or a digital laser recorder. After exposure, the panel is conventionally processed using machinery and chemistry well known in the art of photography, producing a photographically imaged panel over all or part of the print pattern. This method can also use emulsions having an encapsulated developer moiety such that post exposure development occurs in situ after activation using pressure or other methods known in the art. In addition, this method can use coatings providing micro encapsulation of dyestuffs within the print pattern.

Conventional photographic papers or other coated film materials can be cut, for example by being perforated or cut into a print pattern of stripes, suitably adhered to a non-receptive substrate, for example by pressure-sensitive adhesive to a silicone-coated polyester.

The photographic image will be produced on the print pattern of light sensitive paper but not on the substrate.

While all the above Improved Exact Registration methods typically rely on a chemical or other different reaction inside the print pattern than outside the print pattern, they may also benefit from a "topographical" or 'tenting' effect in which the receptive print pattern is geometrically raised above the surrounding substrate area by a significant thickness of, for example screenprinted ink or applied film. This raised surface level may assist the differential receptivity of the print pattern compared to the substrate outside the print pattern by avoiding the conditions required for durable transfer, for example by reducing the effective pressure of transfer rollers outside the print pattern in the Electrostatic Transfer Differential Adhesion Method. However, all the methods of the invention have a non-print-receptive substrate and do not rely on the print pattern being raised to avoid durable image material being outside the print pattern in the finished product. This allows print patterns with areas of substrate exposed which are sufficiently large for the surface to be subject to the full imaging process but not form a durable image material.

Instead of the design being typically printed "right reading" as one or more design layers on a first layer and/or a background layer, the design may be printed in reverse onto the receptive print pattern, for example typically onto a transparent substrate such as polyester film and a transparent first receptive layer to suit any of the above methods, when the design is to be seen through the substrate. For some products, it will be required to cover the reverse printed design with a white and/or other layer to provide the required visual effect of the design when observed through the substrate and first layer. Such backing layer or layers can be applied using a different printing technique, such as screen printing or the same technique as the design layer, for example a white and black backing to a design using the Thermal Transfer Differential Adhesion Method could be made using a thermal transfer foil comprising a layer of white pigmented resin and a layer of black pigmented resin on the same carrier film, for example to manufacture panels according to the GB2165292 in which the design is printed facing a transparent material to be seen through that transparent material.

Panels according to GB 2165292, which are partially printed, can have a design on one side not visible from the other side and a design on the other side not visible from the one side. For such products the intermediate opaque layer or layers may be just white or white-on-black-on-white or white-on-silver on white, to achieve an opaque white background to each design, and such intermediate layers may be applied separately or be combined, for example a white-on-black-on-white multi-layer pigmented resin foil to be transferred by Thermal Transfer Differential Adhesion Method by passing the foil and substrate with clear receptive print pattern and first, reverse-printed design through heated rollers, for example similar to those used for the transfer of electrostatically printed designs from a carrier to a substrate.

All the above methods lend themselves to the mass production of partially processed substrates with standard print-receptive print patterns incorporated on non-print-receptive substrates. These might be referred to as New Part Processed Materials (NPPM) to distinguish them from the partially processed materials disclosed in Methods 3 and 4 of GB 2165292. Such NPPM can be manufactured in bulk, held in stock and distributed to design imagers such as digital printers who can then print the design selectively on the required print pattern but do not have to undertake the difficult and costly ink removal stage of the prior art.

The means of achieving substantially exact registration by differential receptivity can thus be created in a carefully controlled mass-production environment, which cannot be economically matched by the typical individual printer. Thus better quality and cheaper finished products are made possible by this aspect of the invention.

Alternatively, the print pattern can be individually created by a printer to suit the individual requirements of a particular job. This can be assisted by digital production methods to produce a one-off or small volume order with an individually prescribed print pattern. For example, an X-Y plotter with a cutting knife can be programmed to cut out any required print pattern on self-adhesive vinyl with a silicone-coated liner, the unwanted areas being "weeded". This cut film print pattern on a non-print receptive silicone-coated liner can then be imaged overall by any imaging system designed for the self-adhesive vinyl but the image will not form a durable image material on the silicone-coated liner. Similarly, a suitable substrate such as raw polyester can be ink jet printed with a polyester ink to form a print pattern that can then be overprinted with another ink that will adhere to the polyester ink but not to the substrate, or a donor foil with a polyester resin based ink can be thermally transferred to a raw polyester substrate. Conventional thermal transfer pigmented resins will then adhere to this print pattern but not to the raw polyester substrate.

The digital creation of the print pattern particularly assists the creation of stochastic print patterns that have advantages, for example, in the manufacture of products according to GB 2165292, compared to regular dot or line patterns, with which it is far easier to identify a printing defect in the formation of an individual dot or line than with a stochastic pattern of irregular elements. Such digitally produced stochastic patterns may alternatively be used as artwork for mass-production screenprinting of the base pattern.

All the above methods of digital printing have advantages of prior art printing of a relatively fine dot or line "silhouette pattern" according to the '292 patent, in which normal Moire fringe pattern difficulties of conventional printing systems using four color separations are exacerbated by the four color halftone patterns being superimposed on the further dot or line silhouette pattern. The stochastic nature of some digital printing methods and the differing spacing as well as sizing of four color printing elements all help to avoid the creation of Moire fringe patterns.

BRIEF DESCRIPTION OF THE DRAWINGS

Specific embodiments of the invention will now be described by way of example with reference to the accompanying drawings in which.

DESCRIPTION OF PREFERRED EMBODIMENTS

Figure 1:
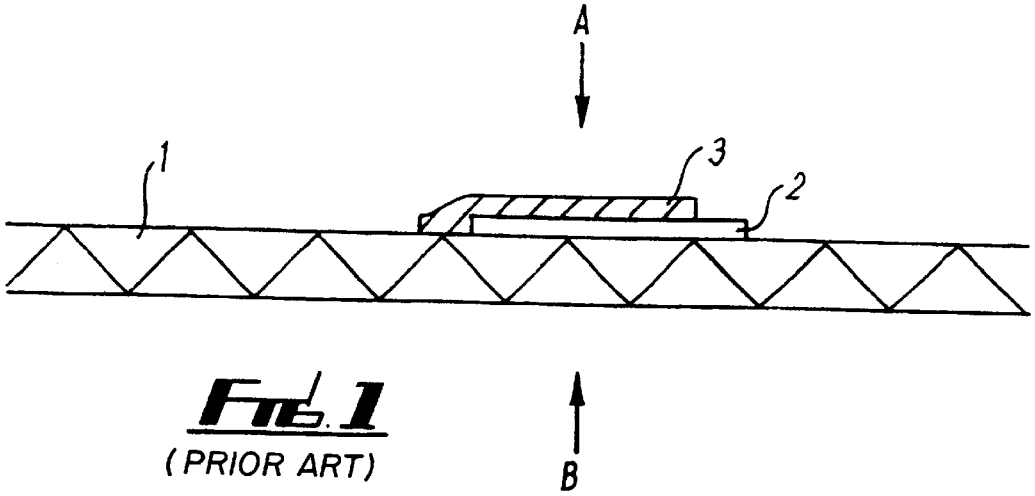
FIG. 1 (PRIOR ART)
FIG. 1 is a section through a prior art partially printed substrate.
Figure 1A:
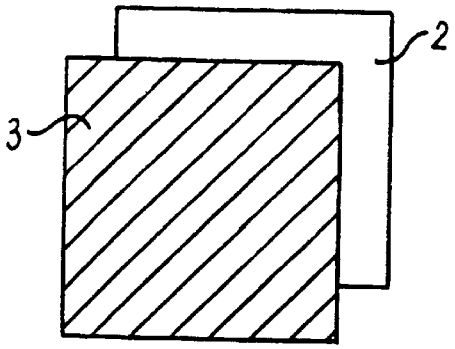
FIG. 1A (PRIOR ART)
FIG. 1A is a plan view of the printed substrate of FIG. 1 in the direction of arrow A.
Figure 1B:
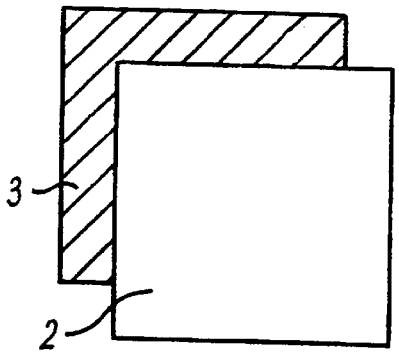
FIG. 1B (PRIOR ART)
FIG. 1B is an under plan view of the substrate of FIG. 1 in the direction of arrow B.

Referring to FIGS. 1, 1A and 1B, a transparent substrate 1 is printed with a white color layer 2 forming a square. A second, transparent color layer 3 is intended to be deposited over the same area as color layer 2. However, owing to the lack of exact registration in the printing process, in plan view, part of the white color layer 2 extends beyond part of the perimeter of the color layer 3. The effect of this lack of registration is that where the color layer 3 overlies the white color layer, the color layer 3 will have its intended hue, intensity and tone. Where the color layer 3 lies outside the white layer 2, it will appear diluted. If the area of the square is relatively small, say less than one square centimeter, the area of exposed white color layer 2 will further "whiten" or reduce the tone from the intended perceived color. If many such areas are printed on a substrate 1, the lack of registration will inevitably differ, so that overall there will be a distinct lack of uniformity in the appearance of the print pattern.

Figure 2A:
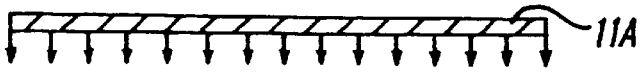
FIGS. 2A through to 2C are sections through a printed substrate illustrating Improved Exact Registration embodiments.
Figure 2A:
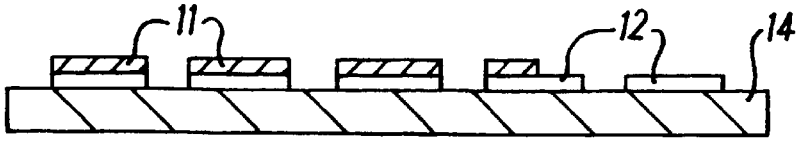

FIGS. 2A through to 2C illustrate the Improved Exact Registration embodiments of the invention. In each embodiment there is a substrate 14 which is non-receptive to the imaging system being used, which is either transparent, tinted transparent, translucent or opaque, typically either a sheet, film or self-adhesive assembly comprising a facestock, pressure-sensitive adhesive and release liner.

In FIG. 2A, background color layer 12 is printed to form and define the desired print pattern. Addressed design 11A is applied to background color layer 12 and substrate 14. Design layer 11 is adhered to and exactly superimposed on white background color layer 12 within its outer boundaries but is not adhered to non-receptive substrate 14.

Figure 2B:
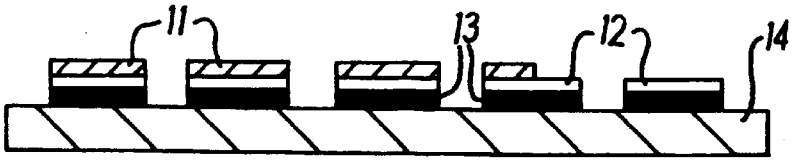

FIG. 2B is similar to FIG. 2A except that black layer 13 is first printed on substrate 14 to form and define the print pattern. White background color layer 12 is applied over the whole panel but only adheres to black layer 13 which it superimposes with exact registration.

Figure 2C:
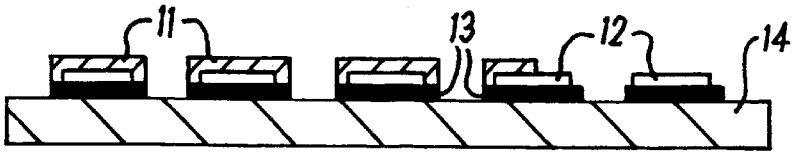

In FIG. 2C, white background color layer 12 is printed by conventional means within black layer 13. Both black layer 13 and white background color layer 12 are receptive to the addressed design 11A which adheres to form design layer 11 within the outer boundaries of addressed design llA, design layer 11 being in exact registration with black layer 13. If design layer 11 is a four color process design comprising transparent or translucent inks, it will be visible where it lies over background color layer 12 but will be substantially invisible where it lies on black layer 13.

Figures 3A, 3B, 3C, 3D:
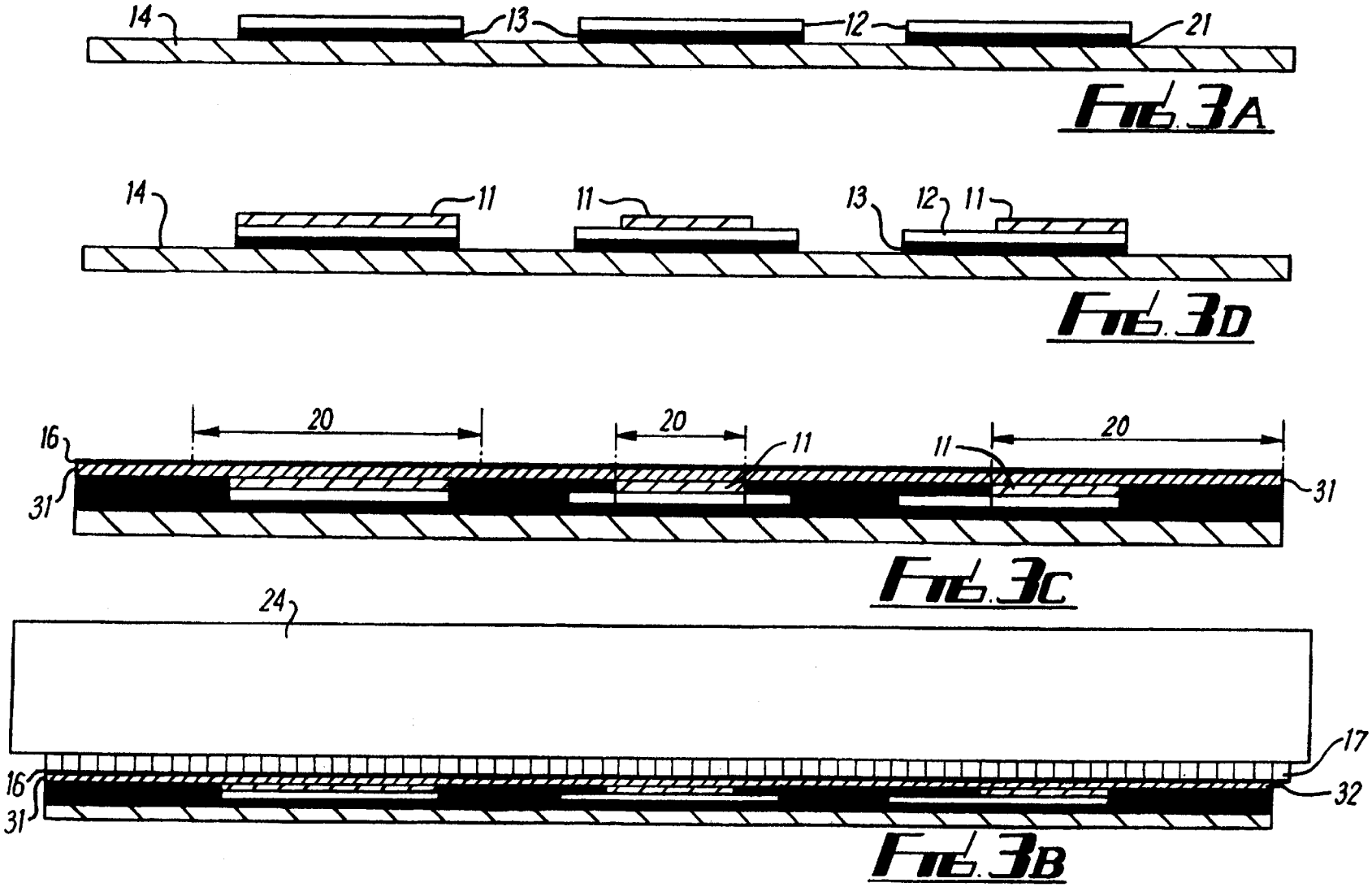
FIGS. 3A to 3D are sections through a printed substrate illustrating the Thermal Transfer Differential Adhesion Method 1.

FIG. 3 illustrates the Thermal Transfer Differential Adhesion Method 1. In FIG. 3A, a pre-printed substrate 21 termed New Part Processed Material of print-treated polyester substrate 14 which is partially printed, preferably by rotary screen printing, using one of the exact registration printing methods of GB 2165292, to form a pre-printed pattern of a white background color layer 12 of Coates Vynalam ink, which is underlain by black layer 13 of Coates Vynaglaze pvc ink. Alternatively, a normal pvc white ink such as Coates Vynaglaze may be overlain by a relatively highly plasticized pvc based clear ink or lacquer to form background color layer 12. A suitable lacquer is HG-70 manufactured by Wiederhold. In FIG. 3B, a conventional thermal transfer ribbon 32 comprises a polyester support 16 and a pigmented resin layer 31. This is presented to the pre-printed substrate 21 passing through thermal head 24 with a hot element imaging array 17 containing mini heat presses which are conventionally activated over addressed design widths 20, to melt and bond the pigmented resin layer 31 into the desired design layer 11, in FIG. 3C. The pigmented resin layer is only transferred to and bonded to the pre-printed portions 12 within the addressed design and not to the intermediate areas of substrate 14, as illustrated in FIG. 3D.

In an alternative interpretation of FIG. 3, instead of the pre-printed substrate 21 being printed by a prior art method of exact registration of black layer 13 and white background color layer 12, black layer 13 is printed in Coates Vynalam ink to form and define the print pattern. White background color layer 11 is formed by thermal transfer, by addressing a white pigmented resin layer over the whole of the substrate, which adhered only to black layer 13 and not to the intermediate substrate 14. The application of design layer 11 is then as previously described, adhering to white background color layer 12 but not to the intermediate substrate 14.

Figure 4A:
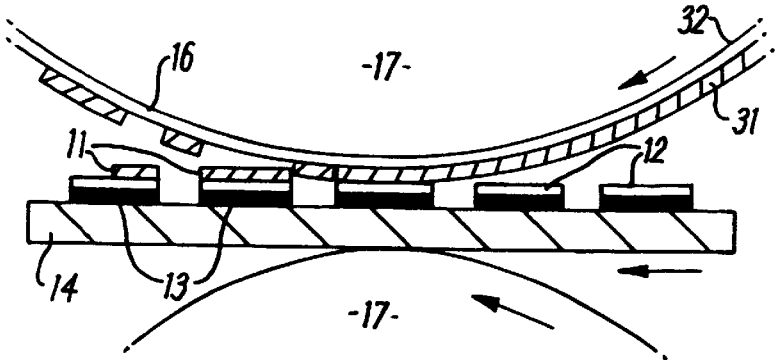
FIGS. 4A and 4B are sections through printed substrates illustrating the Electrostatic Transfer Differential Adhesion Method 2.

FIG. 4A illustrates the Electrostatic Transfer Differential Adhesion Method 2. 32 represents an electrostatically printed conventional transfer medium, such as 3M 8603 Wearcoat, the support 16 typically being of paper and 31 representing the imaged transfer material which incorporates a UV resistant wearcoat, all printed for example using the 3M SCOTCH PRINT process, a trademark of the Minnesota Mining and Manufacturing Company. The pre-imaged design 31 is addressed to the pre-printed substrate 21 with a combination of heat and pressure of laminating rollers 17. The substrate 21 may be of similar construction to the pre-printed substrates described for the Thermal Transfer Differential Adhesion Method 1, having a polyester substrate 14 and a Coates Vynalam white background color layer 12 forming the print pattern. The pre-imaged design 31 only adheres to white background color layer 12 to form design layer 11 and not to substrate 14. If any electrostatically printed toner does transfer to the substrate outside the print pattern, it does not form a durable image material but is easily removable by washing or wiping, which will not affect that toner transferred to the print pattern.

Figure 4B:
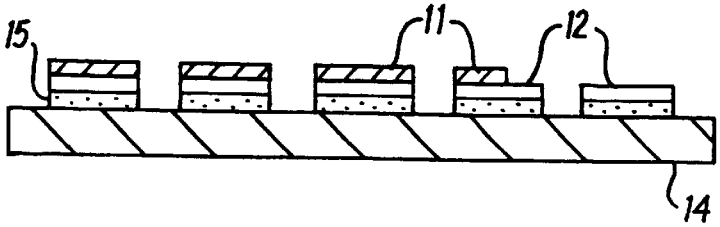

Alternatively, a silicone-coated polyester substrate 14 in FIG. 4B may be used which is not at all receptive to transfer of toner. The print pattern is formed by cut self-adhesive vinyl stripes comprising black pressure-sensitive adhesive 15 and white polyvinyl chloride film facestock 12, which is receptive to the transfer of toner. The addressed design llA of toner 31 is transferred to the surface of the self-adhesive vinyl stripes 12 to form design layer 11 but does not adhere to the silicone-coated substrate 14 outside the print pattern.

Figure 5A:
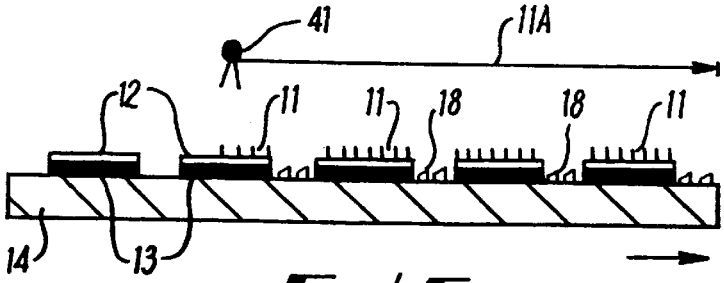
FIGS. 5A and 5B are sections illustrating the Ink Jet Differential Adhesion Method 3.
Figure 5B:
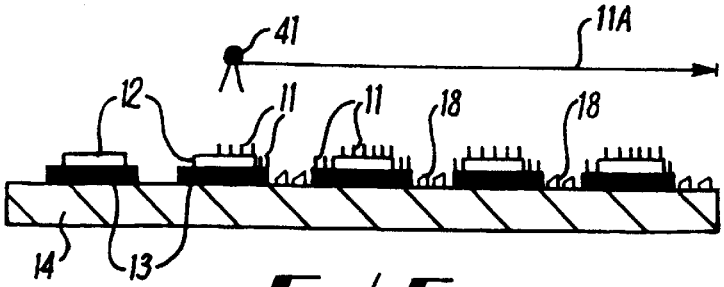

FIG. 5 illustrates the Conventionally Printed or Digital Ink Jet Differential Adhesion Method 3. A pre-printed, hydrophobic substrate 14, such as polyester, incorporates a hydrophilic ink background color layer 12, preferably a white ink, which is underlain by a black layer 13, which also is hydrophilic ink. The black layer 13 is in substantially exact registration with layer 12 as in FIG. 5A or extends beyond the edges of layer 12, as in FIG. 5B. Ink jet or ink jet array 41 deposits water based transparent or translucent inks in a conventional manner as if to form a continuous addressed design 11A. However the ink is only adhered to and cured on the pre-printed ink 12 to form design layer 11. "Free" ink 18 applied between the pre-printed portions of the print pattern is rejected by the hydrophobic substrate 14 and is either absorbed into black layer 13, where it becomes relatively invisible, or is removed in an immediate in-line process, by such means of an air knife, a cleaning roller or other means.

Figure 6A:
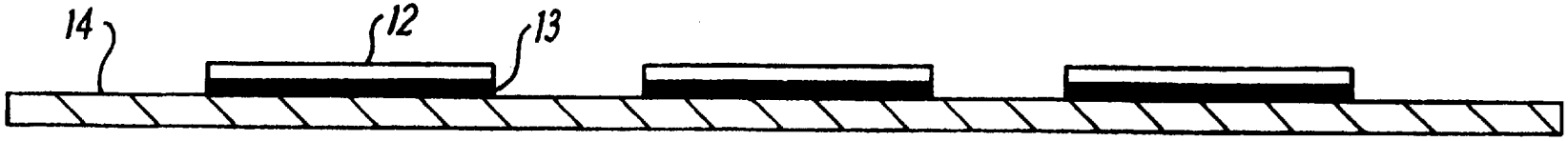
FIGS. 6A to 6C are sections illustrating the Catalytic Ink Jet Method.
Figure 6B:
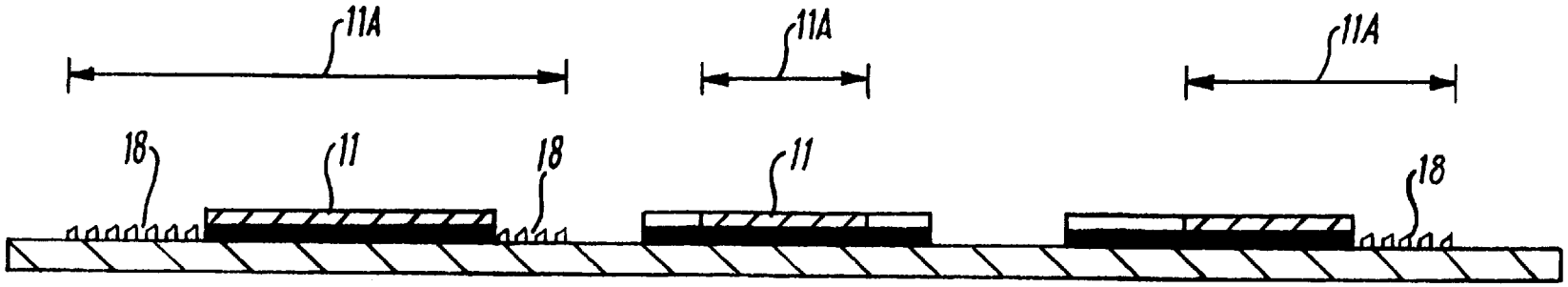
Figure 6C:
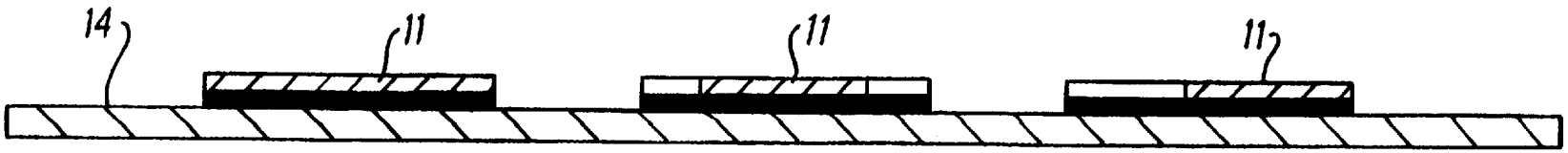

FIG. 6 illustrates the Ink Jet Catalytic Method in which white background color layer 12 superimposed on black layer 13 contains a component A which is catalytic with the ink which contains catalytic component B. The ink jet system supplies the addressed design 11A to the substrate. Design layer 11 is formed into a durable image material because of the catalytic reaction whereas the globules of ink 18 do not undergo a catalytic reaction and can be easily removed by washing or wiping.

Figure 7A:
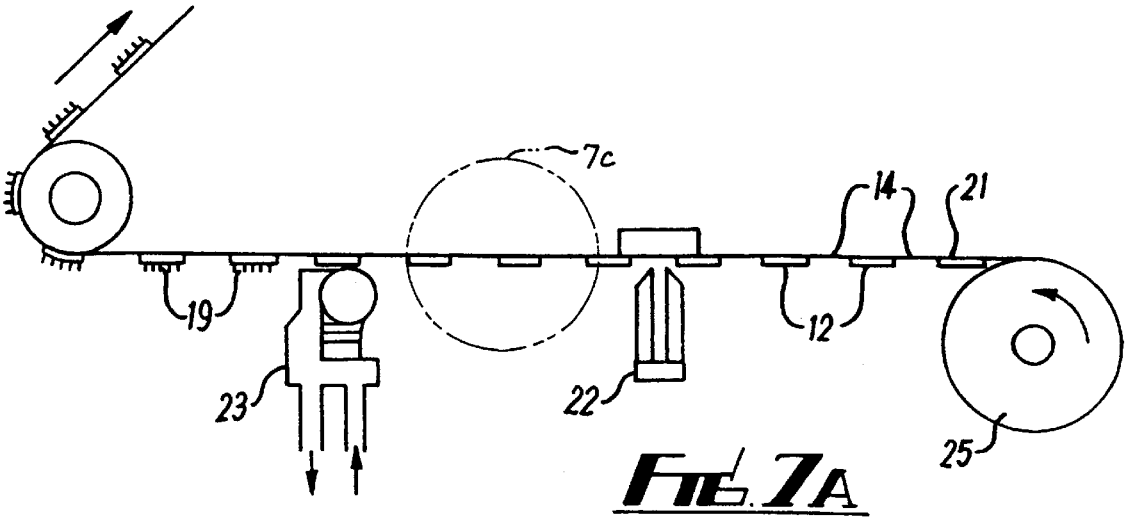
FIG. 7A is a section illustrating the Electrostatic Chargeable Print Pattern Method 4 with FIG. 7C being a close-up view of the circled portion of FIG. 7A.

FIG. 7A illustrates the Electrostatic Chargeable Print Pattern Method 4. A New Part Processed Material 21 comprises a non-receptive substrate 14, such as polyester, and a pre-printed pattern 12 which comprises an electrostatically chargeable first layer 12*a,* preferably white, and a charge containing layer 12*b,* printed by any method, such as screen-printing.

The pre-printed substrate is fed from roll 25 through an electrostatic writing stylus 22 which selectively charges only the pre-printed portions with the desired latent electrostatic image for the particular color of toner in the toner fountain 23, which applies the required design layer image 19 to the pre-printed pattern only, leaving the intermediate areas of substrate 14 unprinted.

Figure 7B:
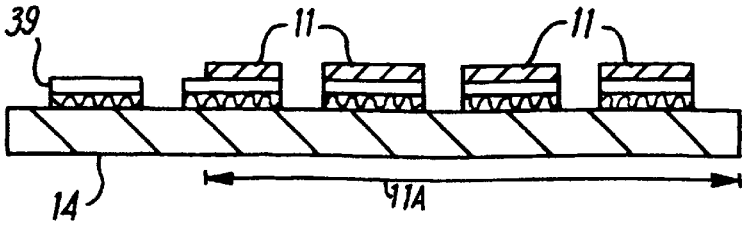
FIG. 7B is a section through a substrate for this method.
Figure 7C:
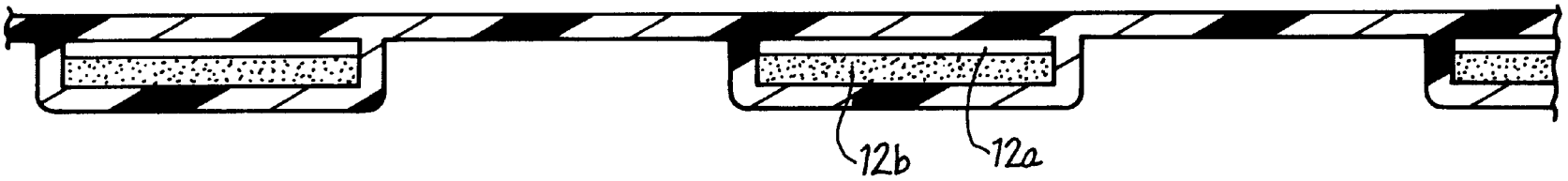
Figure 8A:
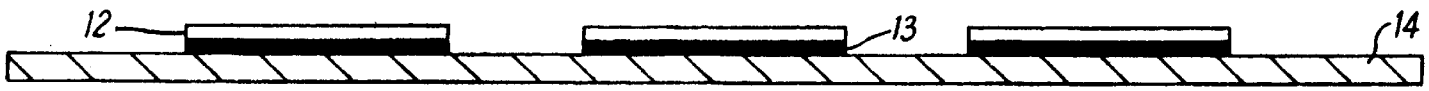
FIGS. 8A to 8D are sections illustrating the Dye Sublimation Method.
Figure 8D:
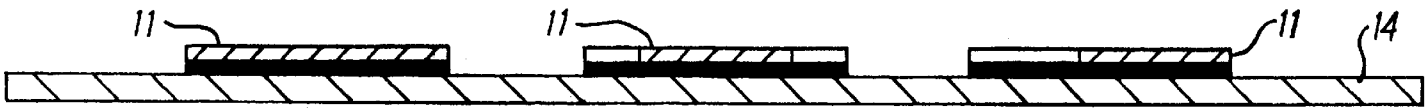
Figure 8C:
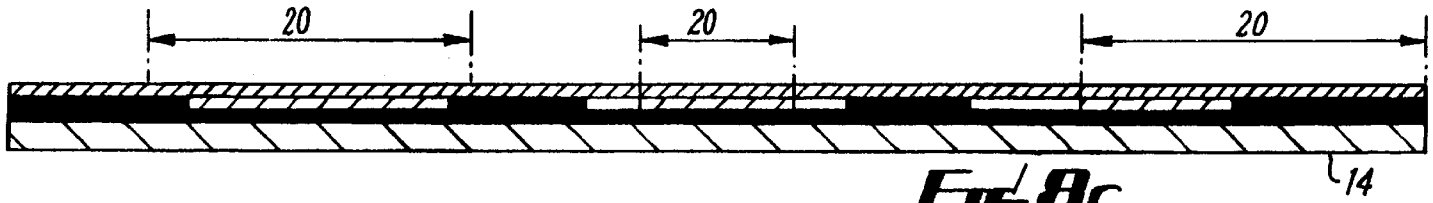
Figure 8B:
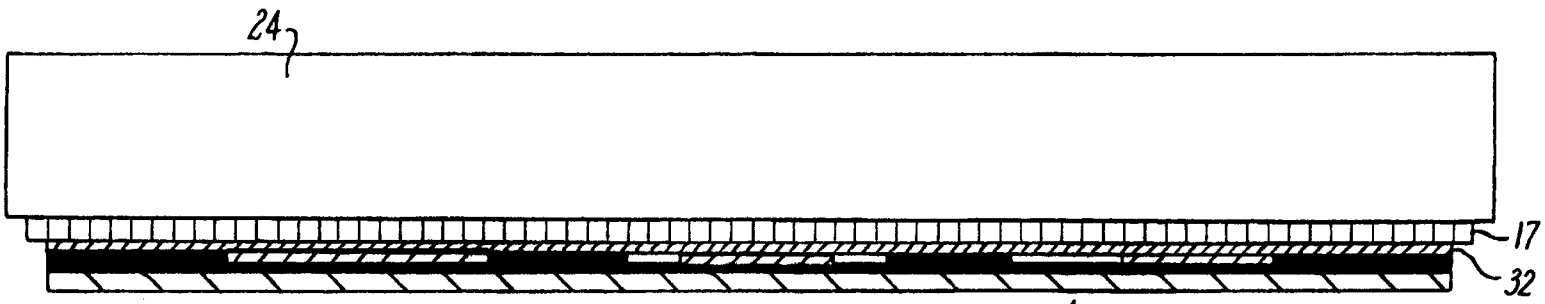

Alternatively, as illustrated in FIG. 7B, the print pattern is defined by cut self-adhesive film 39, ideally in the form of stripes running the length of the substrate web. The self-adhesive film 39 is suited to direct electrostatic imaging, such as 3M DES vinyl, having a chargeable layer and charge capture layer. Toner is attracted only to the stripes charged over addressed design 11A to form design layer 11 and is not attracted to the intermediate substrate 14.

FIG. 8 illustrates the Dye Sublimation Method 5, the elements being similar to the Thermal Transfer Method in FIG. 3, except that white background color layer 12 comprises a coating receptive to dye sublimation imaging. The design layer 11 is sublimated from donor layer 32 within the receptive coating layer 12 after passing through thermal head 24 with the hot element imaging array 17 activated over widths 20 representing the widths of the addressed design.

An alternative embodiment is illustrated in the same FIG. 8 in which black layer 13 is black pressure-sensitive adhesive, white background color layer 12 is a white polyvinyl chloride film with a dye sublimation receptive coating, cut to form the print pattern and applied to substrate 14, which is transparent, silicone-coated polyester. FIGS. 8B, C and D represent the same stages of dye sublimation printing of design layer 11 as previously described.

Figure 9A:
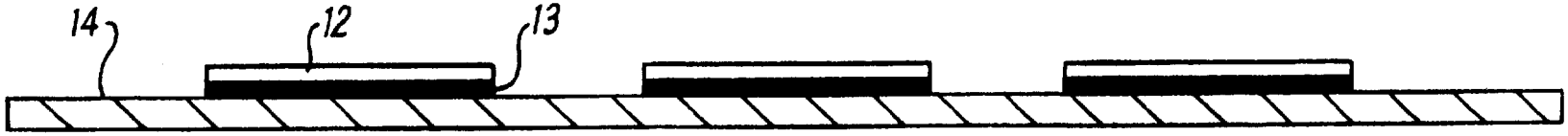
FIGS. 9A to 9C are sections illustrating the Direct Thermal, Photographic and Other Sensitized Material Imaging Methods.
Figure 9B:
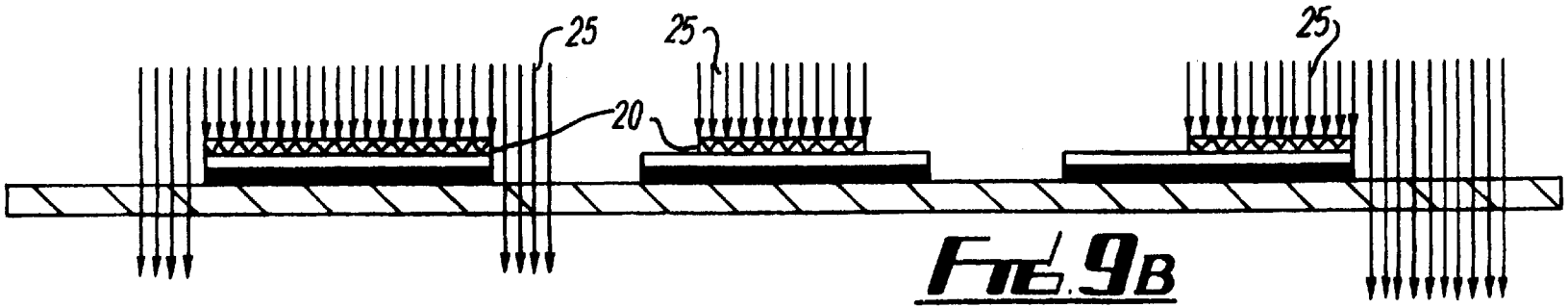
Figure 9C:
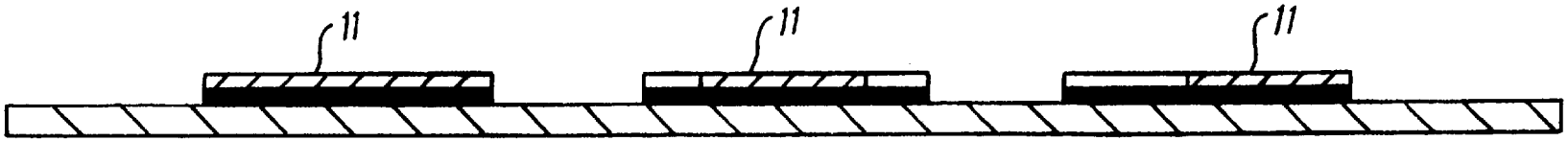

FIG. 9 illustrates the Direct Thermal Method 6 and Photographic or Other Sensitive Materials Imaging Method 7. Substrate 14 is selectively coated with black layer 13 and white background color layer 12, which is receptive to the energy input over the addressed design 25 which converts layer 12 over the addressed design to form design layer 11 within layer 12.

An alternative embodiment illustrated is that black layer 13 is black adhesive adhering direct thermal printing paper 12, cut to form the print pattern, to silicone-coated polyester film substrate 14.

Another alternative embodiment illustrated is that black layer 13 is black adhesive adhering photographic imaging paper 12, cut to form the print pattern, to transparent silicone-coated substrate 14. The photographic image energy input over the addressed design 25 is addressed by a digital photographic system such as DURST. The photographic image is only recorded on imaging paper 12, not on or visible from the other side of the substrate 14 and thus forming a panel according to GB 2165292.

Figure 10A:
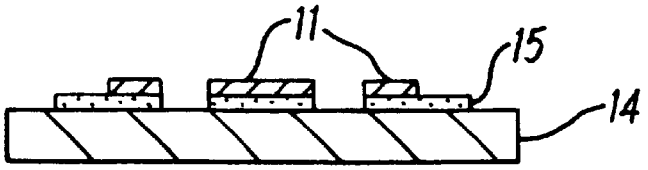
FIGS. 10A to 10D are sections illustrating a design printed in reverse onto a clear substrate.
Figure 10B:
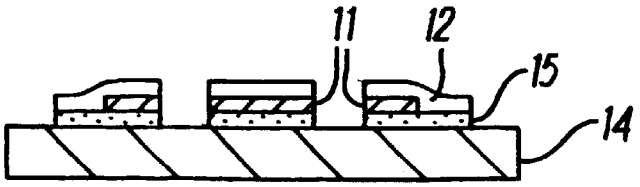
Figure 10C:
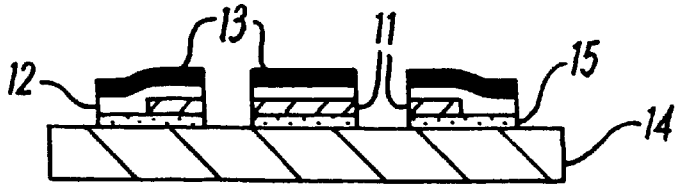
Figure 10D:
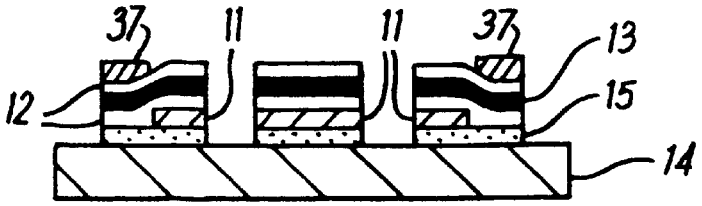

FIG. 10A illustrates clear transparent non-receptive substrate 14 partially covered with a clear transparent first layer 15 which is receptive to reverse printed design layer 11 applied by any method disclosed herein. FIG. 10B illustrates white background color layer 12 applied by any method of differential receptivity disclosed herein, such as thermal transfer printing. FIG. 10C illustrates a product with two background color layers 12 and 13 which are applied separately or may be two layers of pigmented resin transferred together onto receptive layers 15 and 11, for example to form a panel according to GB 2165292. Design 11 is visible through the clear substrate 14 and clear layer 15. FIG. 10D represents a panel according to GB 2165292 with design layer 11 visible through transparent substrate 14 and transparent first layer 15 with a different design 37 visible from the other side of the panel. Intermediate white background color layers 12 and black layer 13 are applied separately or are applied together on one foil by thermal transfer from a carrier through heated rollers, after the printing by differential receptivity of design layer 11. Design layer 37 is then applied by one of the methods of differential receptivity, such as thermal transfer.

FIG. 11 illustrates cross-sections through substrates 14 with cut film, typically in the form of stripes, forming the print pattern. In FIG. 11A, vinyl film facestock 33 and self-adhesive layer 35 are cut to form a print pattern of stripes and are applied to non-receptive substrate 14. In all the cross-sections of FIG. 11, substrate 14 may be a film or sheet material or may itself be a self-adhesive film assembly or may be a removable liner to facilitate the application of the stripes to a window or other base material. Vinyl film facestock 33 is itself receptive or comprises a coating receptive to design layer 11 in FIG. 11B, applied by any method disclosed herein.

Figure 11A:
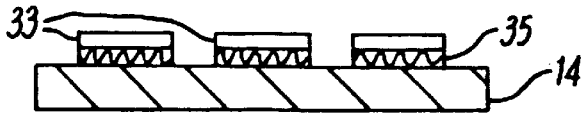
FIGS. 11A to 11I are sections illustrating substrates with cut film stripes forming a print pattern.
Figure 11B:
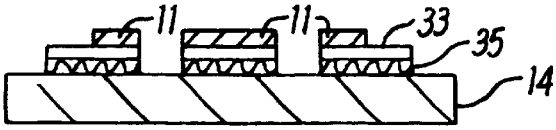
Figure 11C:
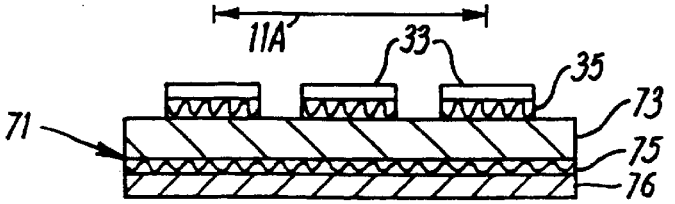
Figure 11D:
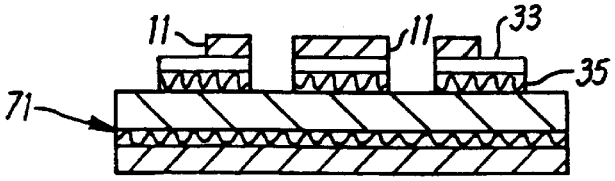
Figure 11E:
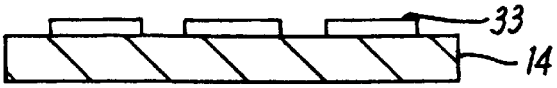
Figure 11F:
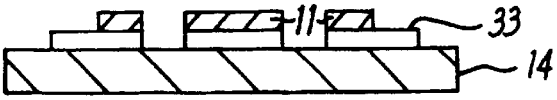
Figure 11G:
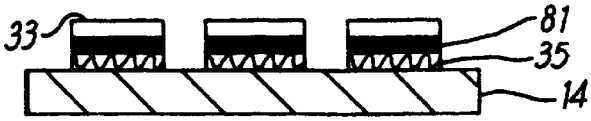
Figure 11H:
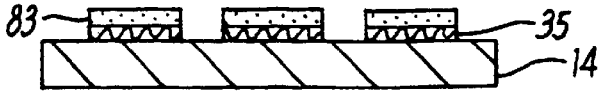
Figure 11I:
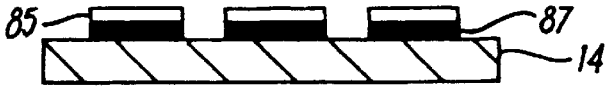

FIGS. 11C and 11D are similar to FIGS. 11A and 11B except that non-receptive substrate 14 is replaced by self-adhesive assembly 71 comprising non-receptive facestock 73, pressure-sensitive adhesive layer 75 and release liner 76. Addressed design 11A forms design layer 11 on vinyl film facestock 33 forming the print pattern but not on the intervening surface of 73. In FIG. 11E cut film stripes 33 form the print pattern and are heat laminated or otherwise adhered to substrate 14. FIG. 11F shows design layer 11 selectively applied to cut film stripes 33. FIGS. 11G and 11H show non-receptive substrate 14 with other cut film stripes forming the print pattern which is receptive to one or more of the Improved Exact Registration printing methods. In FIG. 11G, stripes of white vinyl facestock 33 laminated to a black polyester film 81 with pressure-sensitive adhesive 35 are applied to substrate 14. In FIG. 11H, 83 is a clear transparent vinyl facestock, typically intended to receive a reverse printed design. In FIG. 11I, photographic paper 85 has a black coating 87 and is cut into stripes and adhered to substrate 14.

Figure 12A:
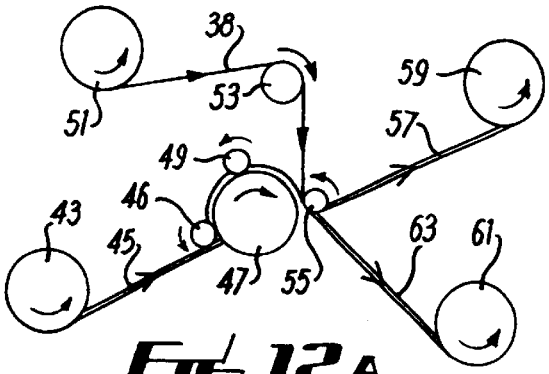
FIGS. 12A to 12K are sections illustrating methods of making and utilising pressure-sensitive adhesives.

FIG. 12A is a cross-section through one type of machine for manufacturing substrates incorporating cut pressure-sensitive adhesive. 43 is an unwind roller for a self-adhesive assembly 45 and 51 is-an unwind roller for a silicone-coated release liner 38 which is redirected around roller 53. Self-adhesive assembly 45 with release liner 36 passes between hardened roller 47 and nip roller 46, then passes around hardened roller 47 to precision ground cutting roller 49 which cuts the self-adhesive assembly, apart from the release liner 36, into narrow stripes, typically 2–6 mm width. At nip roller 55 alternate stripes are removed from the release liner 36 onto release liner 38 to form a substrate with self-adhesive stripes 57 which passes onto rewind roller 59. The stripes remaining on release liner 36 form a substrate with self-adhesive stripes 63 which passes onto rewind roller 61.

Figure 12B:
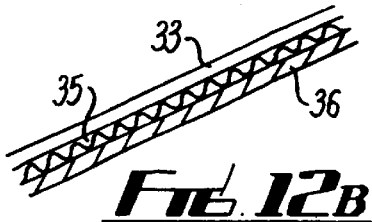
Figure 12C:
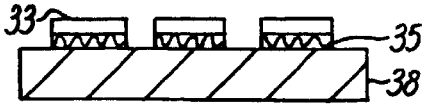

FIG. 12B shows self-adhesive assembly 45 having release liner 36, pressure-sensitive adhesive 35 and white pvc facestock 33. The cutting roller 49 in FIG. 12A face-slits the facestock 33 and pressure-sensitive adhesive 35 but leaves release liner 36 intact. FIG. 12C shows the resulting product 57 with substrate 38 with self-adhesive stripes of pressure-sensitive adhesive 35 and white pvc facestock 33 forming a print pattern. FIG. 12D shows design layer 11 applied to white pvc facestock 33 by one of the Improved Exact Registration printing methods in which no image is present on the intervening silicone-coated substrate 38. For example design layer 11 is imaged by the electrostatic transfer method.

Figure 12E:
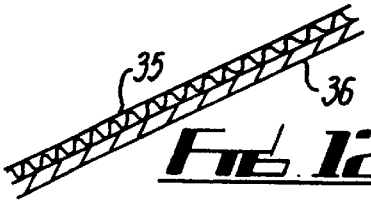
Figure 12D:
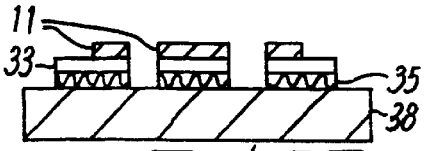
Figure 12F:
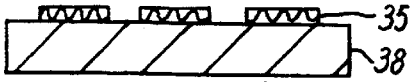
Figure 12I:
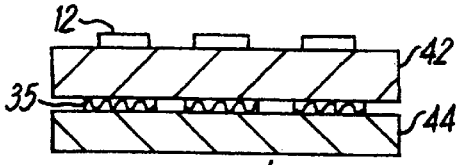
Figure 12G:
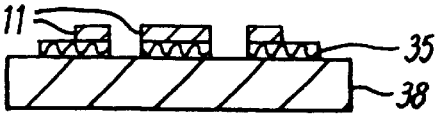

FIG. 12E shows an alternative self-adhesive assembly 45 comprising silicone-coated release liner 36 and white pressure-sensitive adhesive 35. The cutting roller 49 in FIG. 12A back-slits the pressure-sensitive adhesive 35 but not the release liner 36. At nip roller 55 alternate pressure-sensitive adhesive stripes are removed from release liner 36 onto release liner 38 to form a product 57. FIG. 12F shows product 57 with pressure-sensitive stripes 35 on substrate 38. FIG. 12G shows design layer 11 applied to white pressure-sensitive adhesive 35 by one of the Improved Exact Registration printing methods in which no image is present on the silicone-coated substrate 38. For example design layer 11 is imaged by the electrostatic transfer method.

Figure 12J:
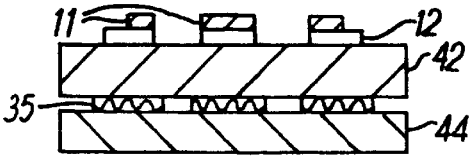
Figure 12H:
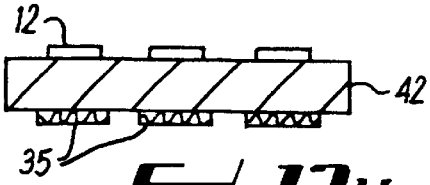
Figure 12K:
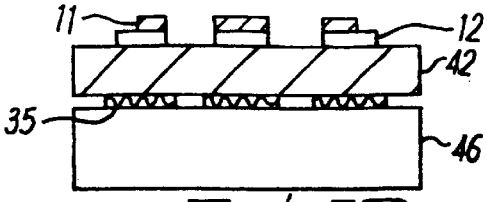

FIG. 12H shows an alternative product 57 produced from 38 in FIG. 12A comprising substrate 42 and printed white lines 12 defining the print pattern. Black pressure-sensitive adhesive stripes 35 are transferred from release liner 36 at nip roller 55 in FIG. 12A to align with and overlap white lines 12. In a separate process, shown completed in FIG. 12I, release liner 44 is applied to pressure-sensitive adhesive stripes 35. In FIG. 12J, design layer 11 is applied to white lines 12 but not to the intervening substrate 38 by one of the Improved Exact Registration Methods. In FIG. 12K, release liner 44 has been removed and pressure-sensitive adhesive 35 has been applied to window 46, forming a panel according to GB 2165292. As well as the previously stated advantages of printing a design with differential receptivity, vision through window 46 between black stripes 35 is not distorted to any degree by an adhesive layer, as is the case with prior art pressure-sensitive printed products with a continuous layer of adhesive. The adhesive tack between substrate 38 and pressure-sensitive adhesive 35 is greater than the tack between the window 46 and pressure-sensitive adhesive 35, providing easy removal of the product with the adhesive from the window, when so required.

In any of the above methods, the substrate may be flat, curved or moulded, to suit particular embodiments of the invention.

The invention is not restricted to the specific embodiments described above and many variations and modifications can be made.

What is claimed is:

1. A method of making a printed panel having a design printed thereon, said design comprising a durable image material design color layer, said method comprising:

printing a print pattern onto a substantially imperforate substrate to form a patterned substrate, said print pattern subdividing said imperforate substrate into printed areas and non-printed areas; and presenting a design-generating medium to said patterned substrate to form an imaged substrate without regard to whether said design-generating medium is being presented to said printed areas or to said non-printed areas of said patterned substrate;

wherein said design-generating medium causes said durable image material design color layer to be formed only on the printed areas of said patterned substrate but not on the non-printed areas of said patterned substrate, said durable image material design color layer being formed by a digital printing method and not extending over the whole of the printed areas of the print pattern; and wherein said design-generating medium causes either (i) no image material to be formed on the non-printed areas of said patterned substrate or (ii) only non-durable image material to be formed on the non-printed areas of said patterned substrate, said non-durable image material being defined as material which can be substantially removed from the non-printed areas of said patterned substrate by the application of water at a pressure of 200 psi (14 kg/cm$^2$) at a flow rate of 10 liters per minute.

2. A method as claimed in claim 1, further comprising substantially removing from said imaged substrate any non-durable image material formed on said imaged substrate by washing said imaged substrate with water at a pressure of 14 kg/cm$^2$ (200 psi) with a rate of water flow of 10 liters/minute.

3. A method as claimed in claim 1, further comprising substantially removing from said imaged substrate any non-durable image material formed on said imaged substrate by air jetting said imaged substrate.

4. A method as claimed in claim 1, further comprising substantially removing from said imaged substrate any non-durable image material formed on said imaged substrate by wiping said imaged substrate with a dry cloth.

5. A method as claimed in claim 1, further comprising completely removing from said imaged substrate any non-durable image material that is formed on said imaged substrate.

6. A method as claimed in claim 5, wherein any non-durable image material formed on said imaged substrate is completely removed from said imaged substrate by washing said imaged substrate with water.

7. A method as claimed in claim 5, wherein any non-durable image material formed on said imaged substrate is completely removed from said imaged substrate by air jetting said imaged substrate.

8. A method as claimed in claim 5, wherein any non-durable image material formed on said imaged substrate is completely removed from said imaged substrate by wiping said imaged substrate with a dry cloth.

9. A method as claimed in claim 1, wherein said printing a print pattern comprises printing lines onto said substantially imperforate substrate.

10. A method as claimed in claim 1, wherein said print pattern is screenprinted onto said substantially imperforate substrate.

11. A method as claimed in claim 1, wherein said printing a print pattern comprises printing a white layer.

12. A method as claimed in claim 11, wherein said printing a print pattern comprises printing an opaque white layer.

13. A method as claimed in claim 11, wherein said printing a print pattern comprises printing a translucent white layer.

14. A method as claimed in claim 11, wherein said printing a print pattern further comprises printing a black layer and wherein said white layer and said black layer are printed in such a manner that:

a cross-section taken through said patterned substrate has two outer edges and said print pattern has alternate printed portions and unprinted portions; every printed portion has two outer edges; within said cross-section, each of said printed portions includes a part of said black layer and a part of said white layer and includes two outer edges of said part of said black layer and two outer edges of said part of said white layer; and said two outer edges of said part of said black layer are coterminous with said two outer edges of said part of said white layer.

15. A method as claimed in claim 11, wherein said printing a print pattern further comprises printing a black layer and wherein said white layer and said black layer are printed in such a manner that:

a cross-section taken through said patterned substrate has two outer edges and said print pattern has alternate printed portions and unprinted portions; every printed portion has two outer edges; within said cross-section, each of said printed portions includes a part of said black layer and a part of said white layer and includes two outer edges of said part of said black layer and two outer edges of said part of said white layer; and said two outer edges of said part of said white layer are spaced within said two outer edges of said part of said black layer.

16. A method as claimed in claim 1, wherein said printing a print pattern comprises printing a black layer.

17. A method as claimed in claim 16, wherein a white background color layer is applied over said black layer forming said print pattern and over said patterned substrate outside said print pattern with said white background color layer adhering to said black layer but not to said patterned substrate outside said print pattern.

18. A method as claimed in claim 17, wherein said white background color layer is applied by thermally transferring a pigmented resin.

19. A method as claimed in claim 1, wherein said printing a print pattern comprises printing a transparent layer.

20. A method as claimed in claim 1, wherein said printing a print pattern comprises printing a tinted transparent substrate with a white layer.

21. A method as claimed in claim 1, wherein said print pattern is printed in a manner such that it is raised above the surrounding substrate.

22. A method as claimed in claim 1, wherein said presenting a design-generating medium causes a transparent or translucent durable image material design color layer to be formed.

23. A method as claimed in claim 1, wherein said printing a print pattern comprises printing on a polyester substrate.

24. A method as claimed in claim 1, wherein said printing a print pattern comprises printing on a raw polyester substrate.

25. A method as claimed in claim 1, wherein said printing a print pattern comprises printing on a substantially imperforate substrate comprising a release coating.

26. A method as claimed in claim 25, wherein said printing a print pattern comprises printing on a substantially imperforate substrate comprising fluoro chemical coated polyester.

27. A method as claimed in claim 1, wherein said printing a print pattern comprises printing on a substantially imperforate substrate comprising silicone-coated polyester.

28. A method as claimed in claim 1, wherein said printing a print pattern comprises printing on a substantially imperforate substrate comprising polyvinyl fluoride.

29. A method as claimed in claim 1, wherein said print pattern is applied to one side of said substantially imperforate substrate and adhesive is applied to part of the other side of said substantially imperforate substrate in approximate register to said print pattern.

30. A method as claimed in claim 29, wherein said applying said print pattern comprises printing white stripes and said applying adhesive comprises applying black pressure-sensitive adhesive stripes.

31. A method as claimed in claim 1, wherein said patterned substrate has slits located within the region of said patterned substrate in which the print pattern is printed.

32. A method as claimed in claim 1, wherein said design color layer is over-printed with a white layer and a black layer.

33. A method as claimed in claim 32, wherein said white layer and said black layer are screenprinted.

34. A method as claimed in claim 32, wherein said over-printing said design color layer with said white layer and said black layer comprises thermally transferring pigmented resin layers.

35. A method as claimed in claim 34, wherein said over-printing said design color layer with said white layer and said black layer comprises transferring said pigmented resin layers from a common thermal transfer foil.

36. A method as claimed in claim 1, wherein said design color layer is overprinted with multiple layers of pigmented resin transferred from a single carrier by thermal transfer.

37. A method as claimed in claim 1, wherein said print pattern is printed as a stochastic pattern.

38. A method as claimed in claim 1, wherein said print pattern is formed by a digital printing method.

39. A method as claimed in claim 1, wherein said design color layer is formed so as to be of substantially uniform hue, intensity, and tone.

40. A method as claimed in claim 1, wherein said digital printing method utilizes Raster Image Processing.

41. A method as claimed in claim 1, wherein said design-generating medium comprises a plurality of digitally addressed micro-elements.

42. A method as claim in claim 41, wherein said micro-elements are individually addressed by an energy impulse.

43. A method as claimed in claim 42, wherein said energy impulse comprises an electrostatic charge.

44. A method as claimed in claim 42, wherein said energy impulse comprises heat.

45. A method as claim in claim 42, wherein said energy impulse comprises light.

46. A method as claimed in claim 41, wherein said micro-elements are individually addressed to said patterned substrate.

47. A method as claimed in claim 46, wherein said design-generating medium is presented to said patterned substrate in a multi-color printing process and said design-generating medium comprises individually addressable micro-elements, said method comprising applying said individually addressable micro-elements to said patterned substrate in one pass of said patterned substrate through a digital printing machine.

48. A method as claimed in claim 41, wherein said micro-elements are individually addressed to a transfer carrier.

49. A method as claimed in claim 41, wherein said micro-elements are individually addressed to a transfer drum.

50. A method as claimed in claim 1, wherein said digital printing method is a thermal transfer method.

51. A method as claimed in claim 50, wherein said thermal transfer method is a thermal mass transfer method.

52. A method as claimed in claim 51, wherein said presenting a design-generating medium to said patterned substrate comprises presenting dye resin to said patterned substrate.

53. A method as claimed in claim 51, wherein said presenting a design-generating medium to said patterned substrate comprises presenting wax to said patterned substrate.

54. A method as claimed in claim 50, wherein said thermal transfer method is a thermal dye sublimation method.

55. A method as claimed in claim 50, wherein a foil comprising a polyester carrier and an image material layer is passed through a transfer head comprising heat presses and said heat presses melt and bond portions of said image material to said patterned substrate.

56. A method as claimed in claim 55, wherein said image material layer comprises pigmented resin and said heat presses melt and bond portions of said resin to said patterned substrate.

57. A method as claimed in claim 50, wherein said presenting a design-generating medium to said patterned substrate comprises presenting ink comprising pvc to said patterned substrate.

58. A method as claimed in claim 51, wherein said ink is gloss ink having a relatively smooth macro surface technology.

59. A method as claimed in claim 50, wherein said presenting a design-generating medium to said patterned substrate comprises presenting ink comprising acrylic and pvc to said patterned substrate.

60. A method as claimed in claim 50, wherein said printing a print pattern comprises printing stripes.

61. A method as claimed in claim 50, wherein said printing a print pattern comprises printing on a polyester material.

62. A method as claimed in claim 61, wherein said printing a print pattern comprises printing on a silicone coated polyester material.

63. A method as claimed in claim 1, wherein said digital printing method is an electrostatic transfer method.

64. A method as claimed in claim 63, wherein said design-generating medium is a pre-imaged transfer medium comprising a carrier film, said method comprising passing said pre-imaged transfer medium through rollers with said substrate and transferring said design-generating medium from said carrier film to said print pattern to form said design layer.

65. A method as claimed in claim 64, wherein said pre-imaged transfer medium is passed through said rollers with said substrate under heat and pressure.

66. A method as claimed in claim 64, wherein no image material is formed on said non-printed areas of said patterned substrate.

67. A method as claimed in claim 64, wherein said print pattern is printed in a manner such that it is raised above the surrounding substrate.

68. A method as claimed in claim 63, wherein said printing a print pattern comprises printings on a polyester film.

69. A method as claimed in claim 63, wherein a first layer of said print pattern is printed using pvc ink.

70. A method as claimed in claim 63, wherein said print pattern is printed using acrylic ink with a pvc content.

71. A method as claimed in claim 1, wherein said presenting a design-generating medium to said patterned substrate comprises presenting ink to said patterned substrate.

72. A method as claimed in claim 71, wherein said ink is presented to said patterned substrate by means of ink jet printing.

73. A method as claimed in claim 71, wherein said print pattern is printed on a substrate which is hydrophobic.

74. A method as claimed in claim 71, wherein water based ink is presented to said patterned substrate.

75. A method as claimed in claim 71, wherein said print pattern is printed using hydrophilic material.

76. A method as claimed in claim 71, wherein said printing a print pattern comprises printing a white layer and a black layer and wherein said white layer and said black layer are hydrophilic.

77. A method as claimed in claim 76, wherein at least some of said ink is absorbed into said black layer.

78. A method as claimed in claim 71, wherein said ink does not adhere to said non-printed areas of said patterned substrate.

79. A method as claimed in claim 71, wherein ink is substantially removed from said non-printed areas of said patterned substrate.

80. A method as claimed in claim 71, wherein ink is substantially removed from said non-printed areas of said patterned substrate by a cleaning roller.

81. A method as claimed in claim 71, wherein ink is substantially removed from said non-printed areas of said patterned substrate by an air knife.

82. A method as claimed in claim 71, wherein ink is substantially removed from said non-printed areas of said patterned substrate by wiping.

83. A method as claimed in claim 71, wherein ink is substantially removed from said non-printed areas of said patterned substrate by washing.

84. A method as claimed in claim 71, wherein said substrate and said ink are cured by the application of an energy source.

85. A method as claimed in claim 84, wherein said substrate and said ink are cured in a heated air drying tunnel.

86. A method as claimed in claim 84, wherein said energy source comprises microwaves.

87. A method as claimed in claim 71, wherein said print pattern comprises a first catalytic component and said ink comprises a second catalytic component and said ink and said print pattern undergo a catalytic reaction.

88. A method as claimed in claim 87, wherein said catalytic reaction is initiated by a post-imaging process.

89. A method as claimed in claim 88, wherein said post-imaging process comprises washing.

90. A method as claimed in claim 71, wherein said ink is a solvent-based ink which adheres to said printed areas or said patterned substrate but not to said non-printed areas of said patterned substrate.

91. A method as claimed in claim 71, wherein said design-generating medium is presented to said patterned substrate using a continuous ink jet system.

92. A method as claimed in claim 71, wherein said design-generating medium is presented to said patterned substrate using a drop-on-demand ink jet system.

93. A method as claimed in claim 92, wherein said design-generating medium is presented to said patterned substrate using a thermal drop-on-demand ink jet system.

94. A method as claimed in claim 92, wherein said design-generating medium is presented to said patterned substrate using a piezo drop-on-demand ink jet system.

95. A method as claimed in claim 92, wherein said design-generating medium is presented to said patterned substrate using a phase-change drop-on-demand ink jet system.

96. A method as claimed in claim 92, wherein said design-generating medium is presented to said patterned substrate using a heated-roller drop-on-demand ink jet system.

97. A method as claimed in claim 1, wherein said print pattern is formed as an electrostatically chargeable layer and a dielectric charge captive layer.

98. A method as claimed in claim 97, wherein said print pattern is printed on a substrate comprising pvc film.

99. A method as claimed in claim 1, wherein said printing a print pattern comprises printing a dielectric charge captive layer on a substrate comprising an electrostatically chargeable layer.

100. A method as claimed in claim 97 or claim 99, wherein said presenting a design-generating medium to said patterned substrate comprises presenting to said patterned substrate 1) an electrostatic latent image which charges said electrostatically chargeable layer and 2) toner which is attracted to said printed areas of said patterned substrate but not to said non-printed areas of said patterned substrate.

101. A method as claimed in claim 100, wherein said toner comprises a liquid toner.

102. A method as claimed in claim 101, wherein said toner is heat fused.

103. A method as claimed in claim 101, wherein said liquid toner is air dried.

104. A method as claimed in claim 100, wherein said toner comprises a powder.

105. A method as claimed in claim 104, wherein said toner is fused by heat and/or by pressure.

106. A method as claimed in claim 1, wherein said print pattern is printed using a dye sublimation-receptive material which absorbs dyestuff in a gaseous state to form said durable image material design color layer.

107. A method as claimed in claim 1, wherein said print pattern is printed as a thermal imaging layer and said design-generating medium comprises thermal energy, said method comprising causing said thermal imaging layer to undergo a color change by subjecting said thermal imagine layer to thermal energy from an imaging head.

108. A method as claimed in claim 107, wherein said thermal imaging layer changes from white to black.

109. A method as claimed in claim 107, wherein said thermal imaging layer changes from white to a full color recording of the durable image design color layer.

* * * * *

UNITED STATES PATENT AND TRADEMARK OFFICE

CERTIFICATE OF CORRECTION

PATENT NO. : 6,267,052 B1
DATED : July 31, 2001
INVENTOR(S) : Hill et al.

It is certified that error appears in the above-identified patent and that said Letters Patent is hereby corrected as shown below:

Title page,
Item [30]:

-- [30] Foreign Application Priority Data

| | | |
|---|---|---|
| Apr. 30, 1997 | (GB) | PCT/GB97/01175 |
| Oct. 24, 1996 | (GB) | PCT/GB96/02600 -- |

Signed and Sealed this

Twentieth Day of August, 2002

*Attest:*

*Attesting Officer*

JAMES E. ROGAN
*Director of the United States Patent and Trademark Office*